US011019930B2

(12) United States Patent
Masunaga et al.

(10) Patent No.: US 11,019,930 B2
(45) Date of Patent: Jun. 1, 2021

(54) LOAD SUPPORT STRUCTURE FOR CHAIR, LOAD SUPPORT BODY FOR CHAIR, AND CHAIR

(71) Applicant: OKAMURA CORPORATION, Yokohama (JP)

(72) Inventors: Hiroshi Masunaga, Yokohama (JP); Syouichi Izawa, Yokohama (JP)

(73) Assignee: OKAMURA CORPORATION, Yokohama (JP)

( * ) Notice: Subject to any disclaimer, the term of this patent is extended or adjusted under 35 U.S.C. 154(b) by 105 days.

(21) Appl. No.: 16/307,878

(22) PCT Filed: Jun. 8, 2017

(86) PCT No.: PCT/JP2017/021341
§ 371 (c)(1),
(2) Date: Dec. 6, 2018

(87) PCT Pub. No.: WO2017/213229
PCT Pub. Date: Dec. 14, 2017

(65) Prior Publication Data

US 2019/0307250 A1 Oct. 10, 2019

(30) Foreign Application Priority Data

Jun. 10, 2016 (JP) ..... 2016-116273
Jun. 10, 2016 (JP) ..... JP2016-116274

(51) Int. Cl.
*A47C 7/00* (2006.01)
*A47C 7/28* (2006.01)
(Continued)

(52) U.S. Cl.
CPC ..... *A47C 7/282* (2013.01); *A47C 7/004* (2013.01); *A47C 7/32* (2013.01); *A47C 7/40* (2013.01); *A47C 31/02* (2013.01)

(58) Field of Classification Search
CPC .... A47C 3/18; A47C 3/20; A47C 5/12; A47C 7/004; A47C 7/282; A47C 7/32; A47C 7/342; A47C 7/40; A47C 7/44
See application file for complete search history.

(56) References Cited

U.S. PATENT DOCUMENTS 6,572,190 B2 * 6/2003 Koepke ..... A47C 1/03255 297/284.1
7,270,378 B2 * 9/2007 Wilkerson ..... A47C 1/023 297/452.13
(Continued)

FOREIGN PATENT DOCUMENTS

CN 1279591 1/2001
CN 1615769 5/2005
(Continued)

OTHER PUBLICATIONS

Japanese Office Action (Application No. JP-2016-116273) dated Nov. 5, 2019.
(Continued)

*Primary Examiner* — Ryan D Kwiecinski
(74) *Attorney, Agent, or Firm* — Nixon Peabody LLP; Jeffrey Costellia

(57) ABSTRACT

A load support structure for a chair includes a tensile material on which a load support surface configured to receive a load of a seated person is formed, a pair of support sections (51) to which the tensile material is attached, and which is elastically deformable in response to a force acting from the tensile material, a first reinforcing section (41) which is disposed to be spaced apart from the pair of support sections (51) in a surface perpendicular direction perpendicular to the load support surface, is located on a side opposite to the load support surface, and extends along an extending direction of the support section, and a connecting body which connects each of both end portion sides of the
(Continued)

support section (51) with a corresponding end portion side of both end portion sides of the first reinforcing section (41), in which the support sections (51) are disposed outside the first reinforcing section (41) in a view of the surface perpendicular direction from the load support surface side.

13 Claims, 14 Drawing Sheets

(51) Int. Cl.

| | |
|---|---|
| ***A47C 31/02*** | (2006.01) |
| ***A47C 7/40*** | (2006.01) |
| ***A47C 7/32*** | (2006.01) |

(56) References Cited

U.S. PATENT DOCUMENTS

| | | | | |
|---|---|---|---|---|
| 8,029,060 | B2 * | 10/2011 | Parker | A47C 1/036 297/300.1 |
| 8,465,095 | B2 * | 6/2013 | Su | A47C 7/44 297/301.1 |
| 9,167,902 | B1 * | 10/2015 | Chen | A47C 3/30 |
| 9,332,851 | B2 * | 5/2016 | Machael | A47C 7/445 |
| 2008/0122285 | A1 * | 5/2008 | Lin | A47C 7/282 297/452.56 |
| 2008/0157580 | A1 * | 7/2008 | Lin | A47C 7/282 297/391 |
| 2008/0315661 | A1 * | 12/2008 | Lin | A47C 7/40 297/452.56 |
| 2016/0360892 | A1 * | 12/2016 | Neil | A47C 7/282 |
| 2019/0307250 | A1 * | 10/2019 | Masunaga | A47C 7/32 |

FOREIGN PATENT DOCUMENTS

| | | | | | |
|---|---|---|---|---|---|
| CN | 201822327 | U | * | 5/2011 | A47C 7/44 |
| DE | 202013101342 | U1 | * | 4/2013 | A47C 7/282 |
| DE | 102012107887 | B3 | * | 11/2013 | A47C 7/44 |
| JP | 2002-172036 | A | | 6/2002 | |
| JP | 2003-000400 | | | 1/2003 | |
| JP | 4061160 | B | | 3/2008 | |
| JP | 2011083518 | A | * | 4/2011 | A47C 7/40 |
| JP | 2014-079510 | A | | 5/2014 | |
| JP | 2015-084941 | | | 5/2015 | |
| JP | 2017217375 | A | * | 12/2017 | |
| WO | WO-02102197 | A2 | * | 12/2002 | A47C 7/282 |
| WO | WO-2014144143 | A1 | * | 9/2014 | A47C 7/445 |
| WO | WO-2016/023128 | A1 | | 2/2016 | |

OTHER PUBLICATIONS

International Search Report for PCT/JP2017/021341, dated Sep. 12, 2017 with English language translation.

Chinese Office Action for App. No. 201780035026.1, dated Mar. 5, 2021.

* cited by examiner

LOAD SUPPORT STRUCTURE FOR CHAIR, LOAD SUPPORT BODY FOR CHAIR, AND CHAIR

TECHNICAL FIELD

The present invention relates to a load support structure for a chair, a load support body for a chair, and a chair.

Priority is claimed on Japanese Patent Application No. 2016-116273, filed Jun. 10, 2016, and Japanese Patent Application No. 2016-116274, filed Jun. 10, 2016, the contents of which are incorporated herein by reference.

BACKGROUND ART

In the related art, a load support structure for a chair and a load support body for a chair, such as a backrest member or a seat member, including a frame member as a strength member and a tensile material having an elastic resistance (repulsive force) against a load from a surface perpendicular direction are generally known.

For example, as described in Patent Document 1, a chair in which a frame-like seat frame is fixed to a frame-like clamping frame, and an end portion of a net member is caught in a fixing portion between the clamping frame and the seat frame is known. In the fixing portion between the clamping frame and the seat frame, protrusions and recessions provided on the clamping frame and the seat frame are engaged with each other and they are screwed together.

In such a configuration, the fixing portion between the clamping frame and the seat frame is firmly fixed by being fitted and screwed to each other. Therefore, only the tensile material stretched on the frame member is displaced in the surface perpendicular direction, and the frame member itself such as the clamping frame or the seat frame does not sufficiently deform against the load of a seated person and is not able to stably support the body of the seated person. In addition, when the load of the seated person acts on a position eccentric from the center of the tensile material, the frame member may come into contact with the body of the seated person and make the seated person feel pain or discomfort.

Thus, as described in Patent Document 2, a structure which includes a tensile material, a pair of vertical frame sections to which the tensile material is attached and which are elastically deformable in response to a force acting from the tensile material, an upper frame section for connecting upper end portions of the pair of vertical frame sections, and a backrest rear part support member for connecting and supporting the upper frame section and lower parts of the vertical frame sections, and in which the vertical frame sections and the backrest rear part support member are annularly formed in a side view has been proposed. In this configuration, since a space is formed in a front-rear direction between the vertical frame section and the backrest rear part support member, when a load from the seated person acts on the tensile material, the vertical frame sections which can be elastically deformed deform greatly rearward to follow the back of the seated person.

DOCUMENT OF RELATED ART

Patent Document

Patent Document 1: Japanese Patent No. 4061160

Patent Document 2: Japanese Unexamined Patent Application, First Publication No. 2014-79510

SUMMARY OF INVENTION

Technical Problem

However, in the configuration described in Patent Document 2, the support section such as the vertical frame section to which the tensile material is attached and the backrest rear part support member for supporting the annular body are disposed at the center of the backrest in a width direction, and when a large load acts on an end portion side in the width direction of the backrest, there is a possibility of the vertical frame section being excessively displaced backward. For this reason, a stable feeling of seating while the frame member such as the vertical frame sections are flexibly deformed is desired.

The present invention has been made in view of the above circumstances, and an object thereof is to provide a load support structure for a chair and a chair that can suppress excessive displacement, while permitting elastic deformation of a support section to which a tensile material is attached.

Further, the present invention has been made in view of the above circumstances, and another object thereof is to provide a load support body for a chair and a chair which can suppress excessive displacement, while permitting elastic deformation of an annular body to which a tensile material is attached.

Solution to Problem

A load support structure for a chair according to the present invention includes: a tensile material on which a load support surface configured to receive a load of a seated person is formed; a pair of support sections to which the tensile material is attached, and which is elastically deformable in response to a force acting from the tensile material; a pair of first reinforcing sections which extends along an extending direction of the pair of support sections and is disposed to be spaced apart from the pair of support sections in a surface perpendicular direction perpendicular to the load support surface, the first reinforcing section being located on a side opposite to the load support surface; and a connecting body which connects each of both end portion sides of the support section with a corresponding end portion side of both end portion sides of the first reinforcing section, in which the support section is disposed outside the first reinforcing section in a view of the surface perpendicular direction from the load support surface side.

In the load support structure for a chair configured as described above, the support sections are disposed to be spaced apart from the first reinforcing section in the surface perpendicular direction. Therefore, the support sections are elastically deformed to follow the body of the seated person, corresponding to a separation distance in the surface perpendicular direction, by the load acting from the seated person. Further, since the support sections are disposed outside the first seat reinforcing rod when the load support surface is viewed in the surface perpendicular direction from the load support surface side, the support sections are pulled by the tensile material, are displaced to the central side of the load support surface, and are displaced so as to rise toward the body side of the seated person and wrap the body from the sides. Therefore, the seated person can sit in a stable state.

Further, even if the seated person sits at a position deviated from the center of the load support surface of the tensile material, since the support section itself is elastically deformed and bent, the user does not feel the hardness of the support section itself and does not feel uncomfortable.

Further, both end portion sides of the support section are connected to the corresponding end portion sides of the first reinforcing section disposed along the support section via the connecting body. Thus, since the support section is supported by the first reinforcing section over the extending direction, excessive displacement is suppressed.

Further, in the load support structure for a chair according to the present invention, each support section may be formed in a plate shape in which the surface perpendicular direction is set as a thickness direction of the support section.

In the load support structure for a chair configured as described above, since the support section is formed in a plate shape in which the surface perpendicular direction is set as the thickness direction, the support section itself is easily deformed by the load support surface. Therefore, the support sections are pulled by the tensile material, and are more easily deformed to rise toward the body side of the seated person and wrap the body from the sides.

Further, in the load support structure for a chair according to the present invention, each support section may be formed such that a thickness in the surface perpendicular direction decreases toward the other support section of the pair of support sections.

In the load support structure for a chair configured as described above, the support section is formed such that the thickness thereof in the surface perpendicular direction becomes thinner toward the other support section of the pair of support sections. Therefore, one side (the inner edge side) of the support section closer to the other support section is pulled by the tensile material and displaced in a load input direction, and the opposite side (the outer edge side) of the support section is easily displaced in the direction of rising against the displacement of the inner edge side.

Further, the load support structure for a chair according to the present invention may further include a pair of connecting sections which connects end portions of the pair of support sections to each other.

In the load support structure for a chair configured as described above, since the end portions of the pair of support sections are connected by the connecting section, excessive displacement of the support section is further suppressed.

The load support structure for a chair according to the present invention may further include a pair of second reinforcing sections which connects end portions of the pair of first reinforcing sections to each other and supports the pair of connecting sections.

In the load support structure for a chair constituted as described above, since the second reinforcing section for supporting the connecting section is provided, the connecting section can be strongly reinforced. Therefore, it is possible to reliably bend the support sections connected to the connecting section, while suppressing the deflection of the connecting section by the load from the seated person.

Further, since the first reinforcing section and the second reinforcing section form an annular shape, the rigidity is enhanced, and the support section can be stably supported.

Further, a chair according to the present invention includes: a support body disposed on a floor surface, and a seat body and a backrest supported on the support body, in which at least one of the seat body and the backrest includes the load support structure for a chair according to any one of the above aspects.

In the chair configured as described above, since at least one of the seat body and the backrest is constituted by the load support structure for a chair according to any one of the above-mentioned aspects, it is possible to suppress excessive displacement, while allowing the elastic deformation of the support section.

A load support body for a chair according to the present invention includes: a tensile material on which a load support surface configured to receive a load of a seated person is formed; and an annular body which is annularly arranged around the tensile material and to which the tensile material is attached, in which the annular body includes: a pair of first parts which is disposed to be spaced apart from each other along the load support surface and is elastically deformable in response to a force acting from the tensile material; and a pair of second parts which is disposed between the pair of first parts in an extending direction of the annular body, and a pair of rigidity reinforcing sections configured to enhance rigidity is provided only on the pair of second parts among the first parts and the second parts.

In the load support body for a chair configured as described above, the tensile material is bent flexibly in the load input direction at the central side of the load support surface, and the first parts of the annular body, which are disposed to be spaced from each other along the load support surface, elastically deform to follow the body of the seated person by the load acting from the seated person. Therefore, the first parts can receive the seated person together with the tensile material by wrapping the seated person.

In addition, since the rigidity reinforcing section for enhancing the rigidity is provided only on the second part among the first parts and the second part of the annular body, the second part can be strongly reinforced. Therefore, excessive displacement and bending of the first parts can be suppressed by the second part disposed between the pair of first parts.

Further, in the load support body for a chair according to the present invention, the rigidity reinforcing section and the second part may be integrally formed in a surface perpendicular direction which is perpendicular to the load support surface.

In the load support body for a chair configured as described above, the integrated body can be formed by integrally forming the rigidity reinforcing section and the second part while increasing the thickness, in the surface perpendicular direction of the load support surface, of the integrated body. Therefore, it can easily be reinforced over a wide range in the extending direction (longitudinal direction) of the second part.

In the load support body for a chair according to the present invention, the rigidity reinforcing section may be configured as a separate body from the second part.

In the load support body for a chair thus configured, since the rigidity reinforcing section is formed as a separate body from the second part, the rigidity reinforcing section is simply connected to the second part by a screw or the like, and the rigidity reinforcing section can be easily manufactured. In addition, the shapes of the rigidity reinforcing section and the second part can be simplified, and the volumes of the rigidity reinforcing section and the second part can be reduced. As a result, it is possible to prevent defective molding of the rigidity reinforcing section and the second part.

Further, in the load support body for a chair according to the present invention, the first part may be disposed on a side closer to an input direction of the load of the seated person than the second part.

In the load support body for a chair configured as described above, since the first parts are disposed on the side closer to the input direction of the load than the second part, the first parts are easily displaced to rise to the body side of the seated person and wrap the body from the sides.

Further, in the load support body for a chair according to the present invention, the annular body may have a pair of connection reinforcing sections which connects end portions of the pair of rigidity reinforcing sections to each other and is disposed to be spaced apart from the pair of first parts in the surface perpendicular direction perpendicular to the load support surface.

In the load support body for a chair configured as described above, since the annular body is formed in an annular shape by the rigidity reinforcing sections and the connection reinforcing sections, the rigidity is enhanced and the first parts of the annular body can be stably supported.

Further, since the first parts are disposed to be spaced apart from the connection reinforcing section in the surface perpendicular direction of the load support surface, the first parts can be elastically deformed sufficiently to correspond to a separation distance in the surface perpendicular direction.

Further, in the load support body for a chair according to the present invention, the first part may be disposed outside the connection reinforcing section in a view of the surface perpendicular direction from the load support surface side.

In the load support body for a chair configured as described above, since the first parts are disposed outside the connection reinforcing section when the load support surface is viewed in the surface perpendicular direction from the load support surface side, the first parts are pulled by the tensile material to easily displace toward the central side of the load support surface, and are easily displaced to rise to the body side of the seated person and wrap around the body from the sides.

Further, in the load support body for a chair according to the present invention, each first part may be formed in a plate shape in which the surface perpendicular direction perpendicular to the load support surface is set as a thickness direction of the first part.

In the load support body for a chair configured as described above, since each first part is formed in a plate shape in which the surface perpendicular direction of the load support surface is set as the thickness direction, the first parts themselves are easily deformed along the load support surface. Therefore, the first parts are pulled by the tensile material, and are more easily displaced to rise toward the body side of the seated person and wrap the body from the sides.

Further, in the load support body for a chair according to the present invention, each first part may be formed such that a thickness in the surface perpendicular direction perpendicular to the load support surface decreases toward the other first part of the pair of first parts.

In the load support body for a chair constituted as described above, each first part is formed such that the thickness thereof in the surface perpendicular direction becomes thinner toward the other first part of the pair of first parts. Therefore, one side (the inner edge side) of the first part closer to the other first part is pulled by the tensile material and displaced to a side away from the input direction of the load, and the opposite side (the outer edge side) of the first part is easily displaced in the direction of rising (to a side close to the input direction of the load) against the displacement on the inner edge side.

Further, a chair according to the present invention includes a support body disposed on a floor surface; and a seat body and a backrest supported on the support body, in which at least one of the seat body and the backrest includes the load support body for a chair according to any one of the above aspects.

In the chair constituted as described above, since at least one of the seat body and the backrest is constituted by the load support body for a chair as described in any one of the above-mentioned aspects, it is possible to suppress excessive displacement while allowing the elastic deformation of the frame rod.

Advantageous Effects of Invention

According to the load support structure for a chair and the chair according to the present invention, it is possible to suppress excessive displacement while allowing elastic deformation of a support section to which a tensile material is attached.

Further, according to the load support body for a chair and the chair according to the present invention, it is possible to suppress excessive displacement, while allowing elastic deformation of an annular body to which a tensile material is attached.

DESCRIPTION OF EMBODIMENTS

First Embodiment

Hereinafter, a chair according to a first embodiment of the present invention will be described with reference to the drawings.

Figure 1:
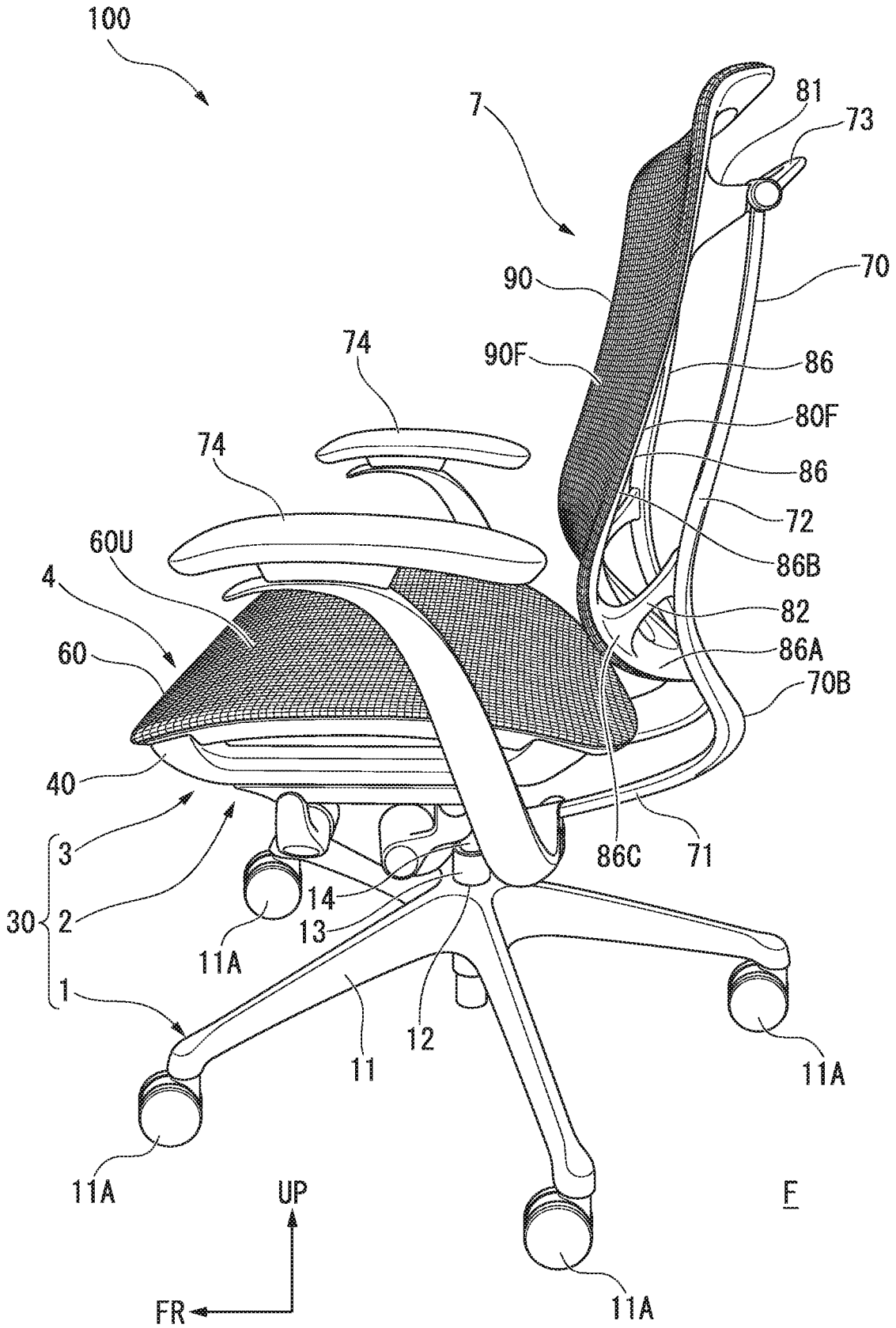
FIG. 1 is a perspective view of a chair according to a first embodiment of the present invention as viewed from a lateral side.
Figure 2:
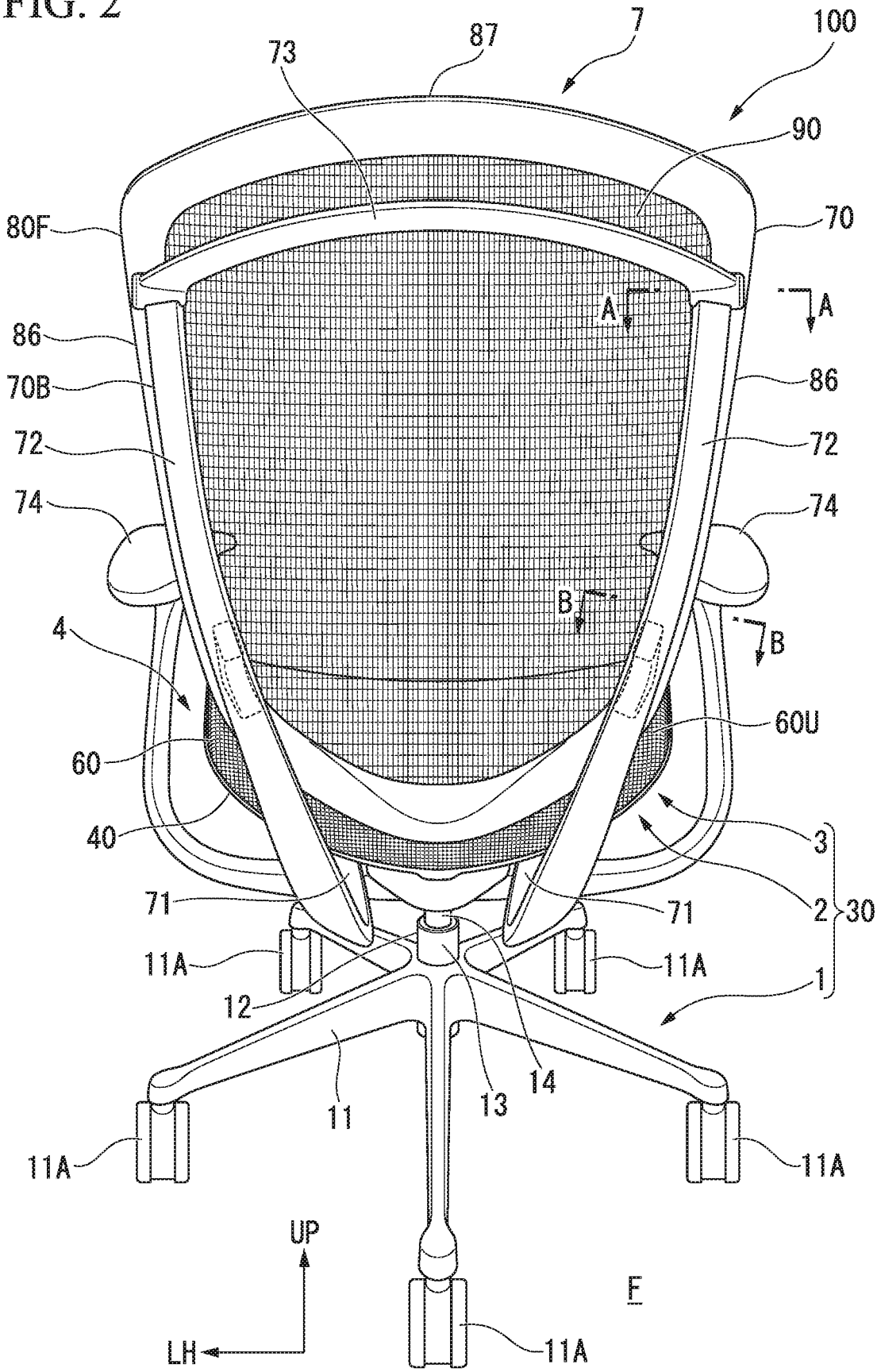
FIG. 2 is a perspective view of the chair according to the first embodiment of the present invention as viewed from behind (a backrest side).

FIG. 1 is a perspective view of a chair according to the first embodiment of the present invention as viewed from a lateral side. FIG. 2 is a perspective view of the chair according to the first embodiment of the present invention as viewed from behind (backrest side).

As shown in FIGS. 1 and 2, a chair 100 has a leg section 1 installed on a floor surface F, a box-like support base 2 (not shown) installed on an upper part of the leg section 1, a seat receiving member 3 attached to an upper part of the support base 2, a seat body (a load support structure of the chair) 4 that is slidably supported by the seat receiving member 3 and on which a seated person sits, and a backrest (a load support structure for a chair) 7 extending from the support base 2 to support the back of the seated person seated on the seat body 4.

In the following description, for convenience, a direction in which the seated person seated on the seat body 4 faces forward is referred to as "forward", and an opposite direction thereof is referred to as "rearward". Further, a direction connecting the floor surface F side on which the chair 100 is installed and an opposite side thereto is referred to as a "vertical direction". Further, a width direction of the chair 100, that is, a horizontal direction orthogonal to the front-rear direction, is referred to as a "left-right direction". In the drawings, the forward direction is indicated by an arrow FR, the upward direction is indicated by an arrow UP, and the leftward direction is indicated by an arrow LH.

The leg section 1 has a multi-legged bar 11 with casters 11A, and a leg pillar 12 which stands up from a central part of the multi-legged bar 11 and incorporates a gas spring (not shown) as an elevating mechanism.

An outer cylinder 13, which constitutes a lower part of the leg pillar 12, is fitted and supported on the multi-legged bar 11 in a non-rotatable manner. The support base 2 is fitted and supported on an upper end portion of an inner cylinder 14 which constitutes an upper part of the leg pillar 12, and a lower part of the inner cylinder 14 is supported by the outer cylinder 13 to be rotatable in the horizontal direction.

The support base 2 incorporates an elevating movement adjustment mechanism of the leg pillar 12, and a tilting adjustment mechanism of the backrest 7.

The seat receiving member 3 has four link arms (not shown) attached to the upper part of the support base 2, and a pair of right and left fixed frames 31 (see a broken line shown in FIG. 3) which connect the link anus to each other.

In this embodiment, the leg section 1, the support base 2, and the seat receiving member 3 constitute a support body 30.

The seat body 4 has a seat frame 40 and an elastically deformable tensile material 60 stretched over the seat frame 40. An upper surface of the tensile material 60 serves as a load support surface 60U that receives the load of the seated person.

Figure 3:
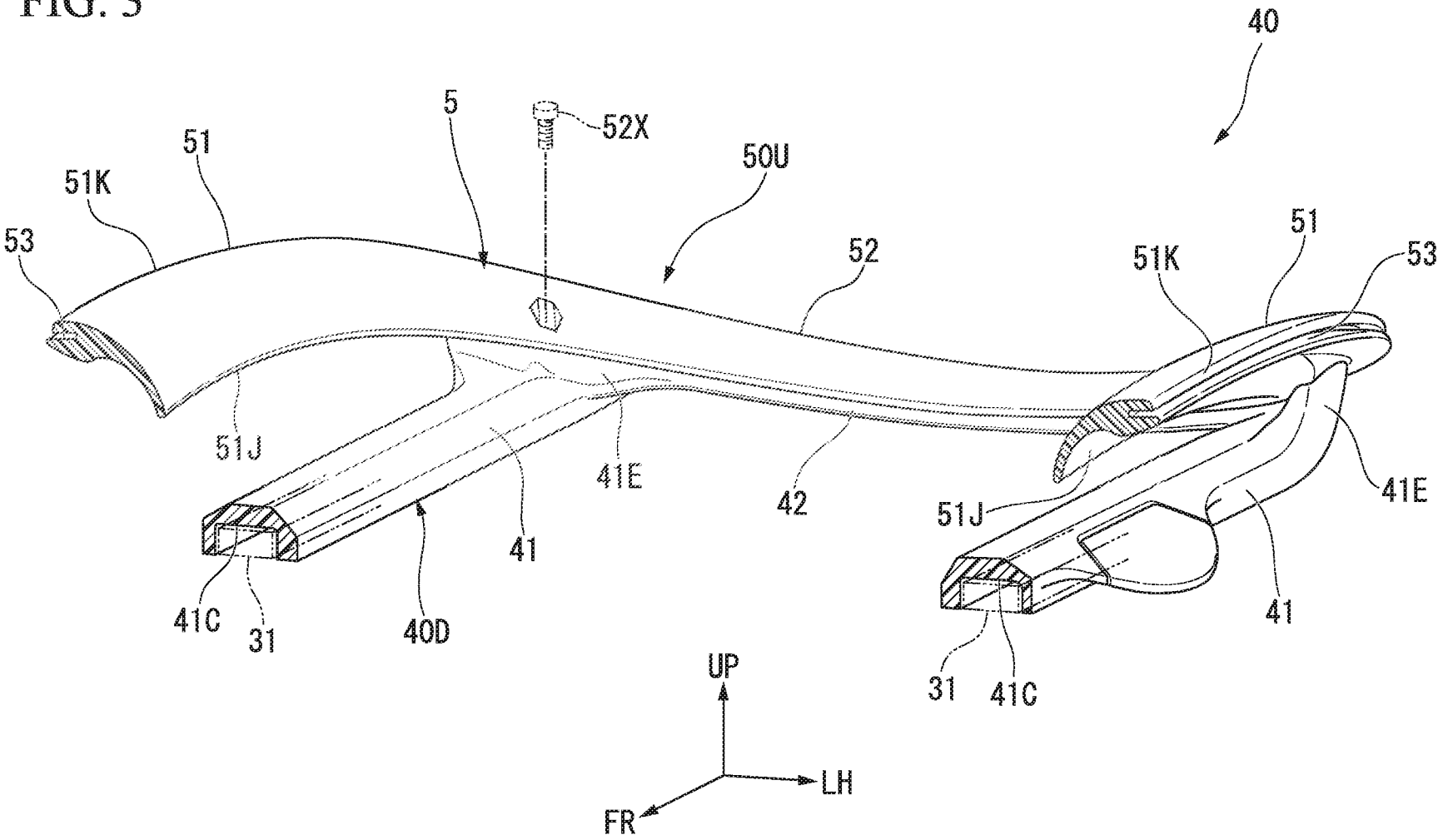
FIG. 3 is a vertical cross-sectional view of a seat body of the chair according to the first embodiment of the present invention taken along a left-right direction.
Figure 4:
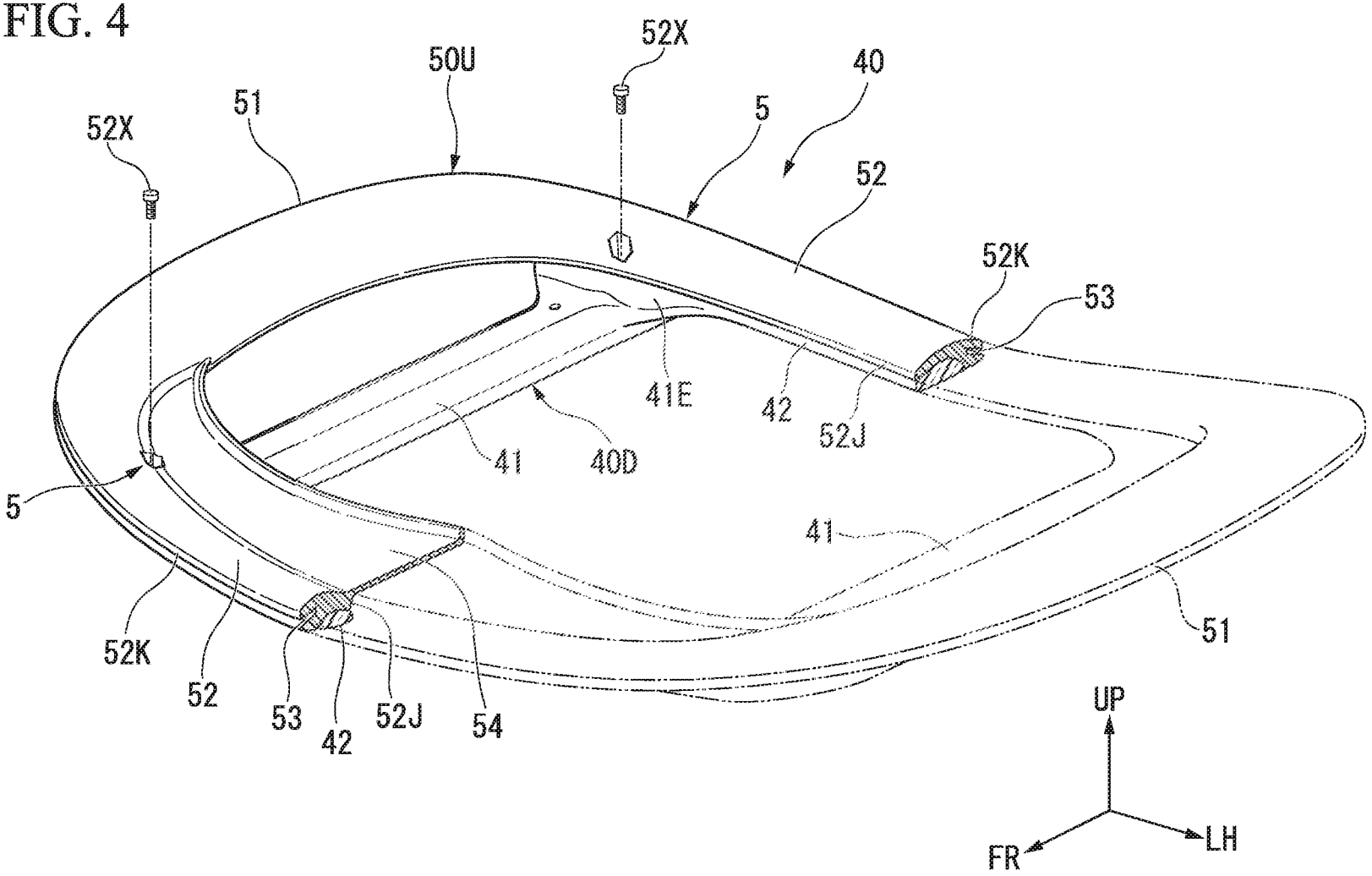
FIG. 4 is a vertical cross-sectional view of the seat body of the chair according to the first embodiment of the present invention taken along a front-rear direction.
Figure 5:
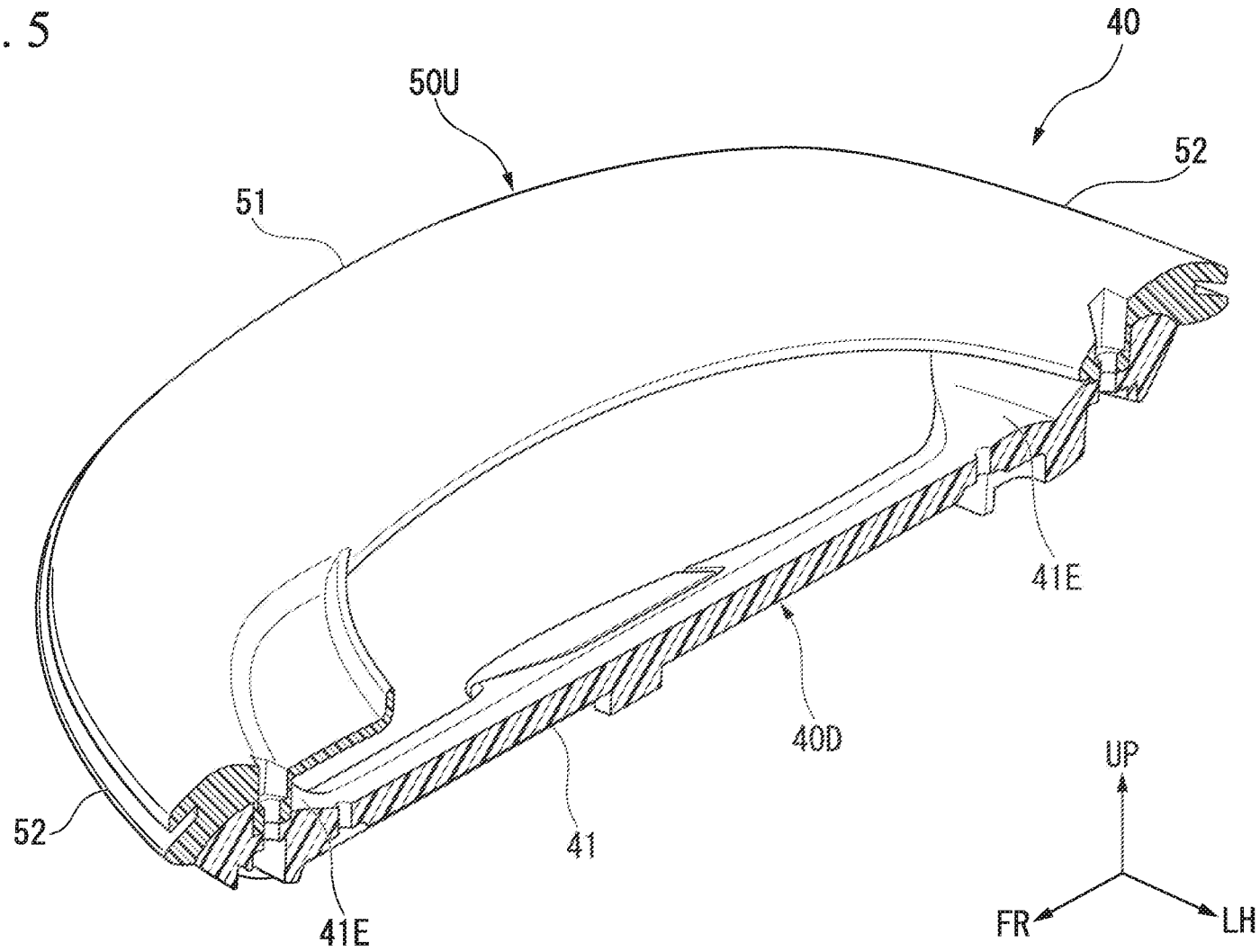
FIG. 5 is a vertical cross-sectional view of the seat body of the chair according to the first embodiment of the present invention taken along the front-rear direction and taken at an outer side in the left-right direction of the seat body compared to FIG. 4.

FIG. 3 is a vertical cross-sectional view of the seat body 4 of the chair 100 taken along the left-right direction. FIG. 4 is a vertical cross-sectional view of the seat body 4 of the chair 100 taken along the front-rear direction. FIG. 5 is a vertical sectional view of the seat body 4 of the chair 100 taken along the front-rear direction. FIG. 5 is a cross-sectional view taken on the outer side in the left-right direction of the seat body 4 compared to FIG. 4. In FIGS. 3 to 5, the tensile material 60 is not shown.

As shown in FIGS. 3 to 5, the seat frame 40 has a seat bottom frame 40D supported by the fixed frames 31, and a seat top frame 50U fixed to an upper surface of the seat bottom frame 40D. Each of the seat bottom frame 40D and the seat top frame 50U is annularly formed.

The seat bottom frame 40D has first seat reinforcing rods (a first reinforcing section) 41 slidably provided on the pair of fixed frames 31, respectively, and second seat reinforcing rods (a second reinforcing section) 42 each of which connects end portions 41E of the first seat reinforcing rods 41 to each other. The first seat reinforcing rods 41 and the second seat reinforcing rods 42 are integrally formed of, for example, a resin or the like, and have a predetermined strength.

As shown in FIG. 3, the first seat reinforcing rod 41 extends in the front-rear direction. The first seat reinforcing rod 41 has a downward U shape in a cross section along a surface perpendicular direction, which is a direction perpendicular to the load support surface 60U (see FIG. 1, the same applies hereinafter). In other words, a concave section 41C that is recessed upward is formed in a lower part of the first seat reinforcing rod 41. The fixed frame 31 is disposed in the concave section 41C.

Both end portions 41E of the first seat reinforcing rod 41 are formed to have a larger width in the left-right direction than a portion of the first seat reinforcing rod 41 on a central side in the front-rear direction. Both end portions 41E of the first seat reinforcing rod 41 are gradually inclined upward toward a distal end side.

As shown in FIG. 4, the second seat reinforcing rod 42 extends in the left-right direction. The second seat reinforcing rod 42 has a plate shape wider in the front-rear direction, in a cross section along the surface perpendicular direction (a vertical cross section along the front-rear direction).

As shown in FIGS. 3 to 5, the seat top frame 50U includes a pair of frame rods (a support section) 51 disposed to be spaced apart from each other in the left-right direction (in a direction along the load support surface 60U), and connecting rods (a connecting section) 52 each of which connects end portions of the frame rods 51 to each other. The frame rods 51 and the connecting rods 52 are integrally formed of, for example, a resin or the like, and configured to be elastically deformable in response to a force acting from the tensile material 60 (see FIG. 1, the same applies hereinafter).

As shown in FIG. 3, the frame rod 51 extends in the front-rear direction. The frame rod 51 has a plate shape extending along the load support surface 60U and wider in the left-right direction, in a cross section along the surface perpendicular direction (a vertical cross section along the left-right direction).

The frame rod 51 is formed such that the thickness thereof in the surface perpendicular direction becomes thinner toward an inner edge (an inner end portion in the left-right direction) 51J. Further, the inner edge 51J of the frame rod 51 is inclined downward.

A groove 53 recessed inward is formed in an outer edge (an outer end portion in the left-right direction) 51K of the frame rod 51. An end portion of the tensile material 60 is caught in the groove 53.

As shown in FIG. 4, the connecting rod 52 extends in the left-right direction. The connecting rod 52 has a plate shape wider in the front-rear direction, in a cross section along the surface perpendicular direction (a vertical cross section along the front-rear direction).

The rear connecting rod 52 is gradually inclined downward toward the rear.

The rear connecting rod 52 is formed such that the thickness thereof in the surface perpendicular direction becomes thinner toward an inner edge (an inner end portion in the front-rear direction) 52J. A reinforcing plate section 54 having a plate shape extending along the horizontal plane is provided on the inner edge 52J of the front connecting rod 52.

Both end portions of the reinforcing plate section 54 in the left-right direction are connected to the respective frame rods 51. Therefore, a front part of the seat top frame 50U including a boundary region between the frame rod 51 and the connecting rod 52 is prevented from hanging down forward and downward due to the load that is input from the body of the seated person.

A cushion body having elasticity (not shown, the same applies hereinafter) may be placed on an upper surface of the reinforcing plate section 54. As a result, a front part of the tensile material 60 stretched over the seat top frame 50U is supported by the cushion body and urged upward. The seated person feels a good seating comfort while thighs of the seated person are flexibly supported on the tensile material 60, and because the thighs do not come into direct contact with an inner peripheral edge of the connecting rod 52, the seated person does not feel the hardness of the connecting rod 52 and does not feel uncomfortable.

The groove 53 recessed inward is formed on an outer edge (an outer end portion in the front-rear direction) 52K of the connecting rod 52. The end portion of the tensile material 60 is caught in the groove 53.

The second seat reinforcing rod 42 is provided on a lower part on the inner edge 52J side of the connecting rod 52. Both end portions of the connecting rod 52 are screwed to the respective end portions of the second seat reinforcing rod 42 by screws 52X.

The length of the connecting rod 52 is longer than the length of the second seat reinforcing rod 42 of the seat bottom frame 40D. As a result, the frame rod 51 connected to the end portion of the connecting rod 52 is disposed on the outer side (the outer side in the left-right direction) than the first seat reinforcing rod 41 connected to the end portion of the second seat reinforcing rod 42 when the load support surface 60U is viewed in the surface perpendicular direction from the load support surface 60U side.

In the present embodiment, the end portions of the connecting rods 52, the end portions of the second seat reinforcing rods 42, and the screws 52X constitute a connecting body 5 which connects the frame rod 51 and the first seat reinforcing rod 41. Since the end portion 41E of the first seat reinforcing rod 41 is gradually inclined upward toward the distal end side, the frame rod 51 is disposed above the first seat reinforcing rod 41.

Further, the end portion of the connecting rod 52 is gradually inclined upward toward the outer side in the left-right direction. As a result, the frame rod 51 is disposed above the connecting rod 52.

As shown in FIGS. 1 and 2, the backrest 7 includes a back frame 70, and a tensile material 90 stretched over the back frame 70. A front surface of the tensile material 90 serves as a load support surface 90F that receives the load of the seated person.

The back frame 70 has a back rear frame 70B connected to the support base 2, and a back front frame 80F provided in front of the back rear frame 70B.

The back rear frame 70B has lower side portions 71, lateral side portions (a first reinforcing section) 72, and an upper side portion 73. The lower side portions 71, the lateral side portions 72, and the upper side portion 73 are formed integrally by, for example, a metal such as aluminum or a resin having a predetermined strength.

The lower side portions 71 are connected to the tilting adjustment mechanism in the support base 2 and extend from both the left and right sides of the rear part of the support base 2. The lower side portion 71 is gradually inclined rearward toward the upper part. Also, an armrest 74 extending sideways is provided in each lower side portion 71.

The lateral side portion 72 is connected to the upper end portion of each lower side portion 71. Each lateral side portion 72 is gradually inclined outward in the left-right direction toward the upper part.

A lower part of the lateral side portion 72 is gradually inclined forward toward the upper part.

An upper part of the lateral side portion 72 is gradually inclined rearward toward the upper side. The upper parts of the lateral side portions 72 are connected to each other by the upper side portion 73.

Figure 6:
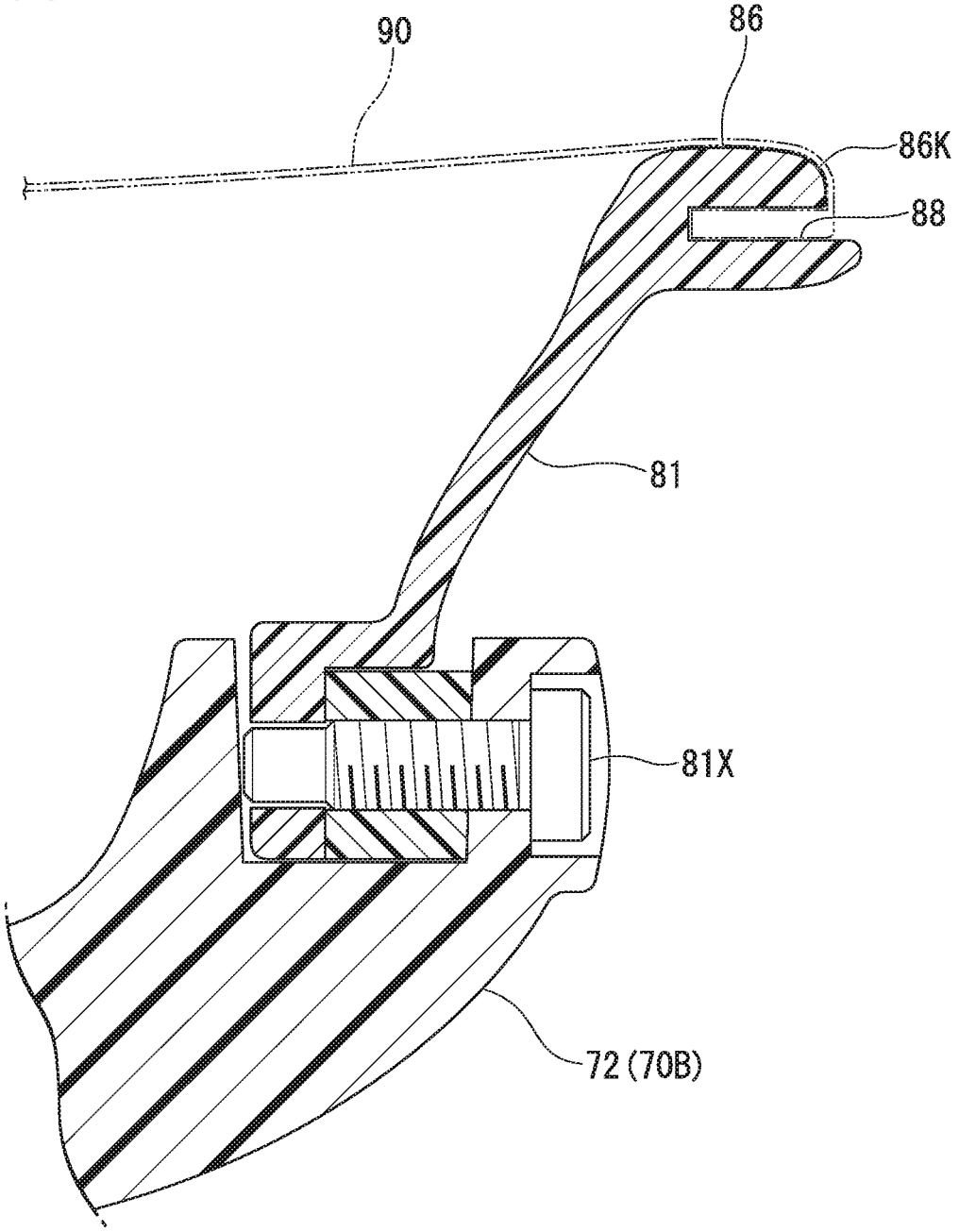
FIG. 6 is a cross-sectional view taken along a line A-A of FIG. 2.
Figure 7:
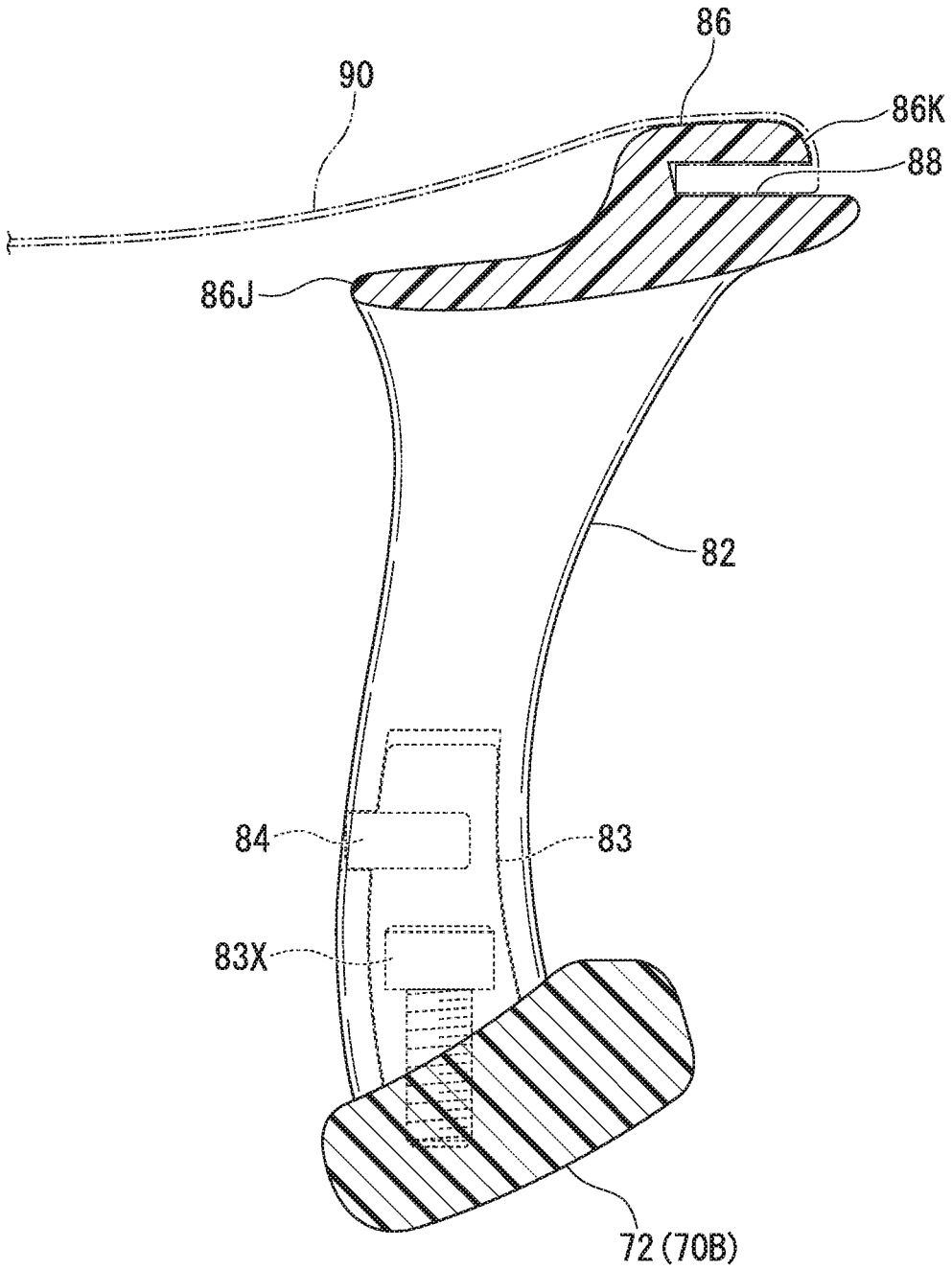
FIG. 7 is a cross-sectional view taken along a line B-B of FIG. 2.

FIG. 6 is a cross-sectional view taken along the line A-A of FIG. 2. FIG. 7 is a cross-sectional view taken along the line B-B of FIG. 2.

As shown in FIGS. 1, 2, 6, and 7, the back front frame 80F has upper arm sections (a connecting body) 81 connected to the upper parts of the lateral side portions 72 of the back rear frame 70B, lower arm sections (a connecting body) 82 connected to the lower parts of the lateral side portions 72, a pair of vertical rods (a support section) 86 disposed to be spaced apart from each other in the left-right direction (along load support surface 60U), and an upper rod (a connecting section) 87 which connects the upper ends of the pair of vertical rods 86. The upper arm sections 81, the lower arm sections 82, the vertical rods 86, and the upper rod 87 are integrally formed of, for example, resin or the like. The vertical rods 86 and the upper rod 87 are configured to be elastically deformable in accordance with the force acting from the tensile material 90.

As shown in FIG. 6, the upper arm section 81 is fixed to the upper part of the lateral side portion 72 of the back rear frame 70B by a bolt 81X. The upper arm section 81 extends forward from the lateral side portion 72 of the back rear frame 70B, and gradually extends outward in the left-right direction toward the front part.

As shown in FIG. 7, a fixed piece 83 is fixed to the lower part of the lateral side portion 72 of the back rear frame 70B with a bolt 83X. The lower arm section 82 externally fits the fixed piece 83. The lower arm section 82 and the fixed piece 83 are fixed by a retaining pin 84. The lower arm section 82 extends forward from the lateral side portion 72 of the back rear frame 70B and gradually extends outward in the left-right direction toward the front part.

As shown in FIG. 1, the upper arm section 81 is connected to the upper part of the vertical rod 86, and the lower arm section 82 is connected to the lower part of the vertical rod 86.

As shown in FIG. 2, each vertical rod 86 extends in the vertical direction. In detail, the vertical rod 86 is gradually inclined inward in the left-right direction toward the lower part. The lower ends of the pair of vertical rods 86 are connected to each other.

As shown in FIG. 1, a lower part 86A of the vertical rod 86 is gradually inclined forward toward the upper part. An upper part 86B of the vertical rod 86 is gradually inclined rearward toward the upper part. Accordingly, in a side view, a boundary section 86C between the lower part 86A and the upper part 86B has a shape protruding forward. The lower arm section 82 is connected to a rear surface of the boundary section 86C.

As shown in FIGS. 6 and 7, the vertical rod 86 has a plate shape extending along the load support surface 90F and wider in the left-right direction, in a cross section along the surface perpendicular direction, which is a direction perpendicular to the load support surface 90F (see FIG. 1) (a horizontal cross section along the left-right direction).

As shown in FIG. 7, the lower part of the vertical rod 86 is formed such that the thickness thereof in the surface perpendicular direction becomes thinner toward an inner edge (an inner end portion in the left-right direction) 86J.

A groove 88 recessed inward is formed in an outer edge (an outer end portion in the left-right direction) 86K of the vertical rod 86. The end portion of the tensile material 90 is caught in the groove 88.

Since the upper arm section 81 and the lower arm section 82 gradually extend outward in the left-right direction toward the front, the vertical rod 86 is disposed outside the lateral side portion 72 in the left-right direction.

Next, the deformation of the seat body 4 when the seated person sits on the seat body 4 of the chair 100 will be described.

First, a description will be given of a case (hereinafter, this case will be referred to as a first seated state) in which the seated person sits on the rear part of the central part in the left-right direction (width direction) of the load support surface 60U of the seat body 4.

Since the load support surface 60U is made up by the elastically deformable tensile material 60, the tensile material 60 elastically deforms to sink downward by the load acting from the seated person.

Since the rear connecting rod 52 on which the tensile material 60 is stretched gradually inclines downward toward the rear, the connecting rod 52 is easy to elastically deform downward. Here, since the second seat reinforcing rod 42 is provided at the lower part of the connecting rod 52, bending of the central part in the left-right direction of the connecting rod 52 is suppressed.

Both the left and right sides of the front end portion of the rear connecting rod 52 and both the left and right sides of the rear end portion of the front connecting rod 52 are connected by the first seat reinforcing rods 41, respectively. Therefore, the left and right frame rods 51, which are disposed outside in the left-right direction than the connecting rods 52, are restrained by the connecting rod 52 and elastically deform gradually upward from the rear part.

Next, the description will be given of a case (hereinafter, this case will be referred to as a second seated state) in which the seated person sits slightly in front of a central part in the front-rear direction of the load support surface 60U of the seat body 4 and the central part in the left-right direction (width direction) of the load support surface 60U.

In the second seated state, since the seating position is ahead of the first seated state, the amount of elastic deformation of the rear connecting rod 52 toward the lower side is smaller than in the case of the first seated state.

However, the frame rods 51, each of which has a plate shape in the cross-sectional view taken along the surface perpendicular direction of the tensile material 60, are pulled by the tensile material 60 elastically deforming in the surface perpendicular direction, rise toward the body side of the seated person, and elastically deform to wrap the body from the sides. At this time, the pair of front and rear connecting rods 52 suppress excessive elastic deformation of the frame rods 51.

Next, the deformation of the backrest 7 when the seated person puts his back against the backrest 7 will be described.

When the back is put against the load support surface 90F of the backrest 7 made up of the tensile material 90, the load in the surface perpendicular direction acting on the tensile material 90 is not so large as the load acting on the load support surface 60U of the seat body 4.

Further, the vicinity of the boundary sections 86C that protrude forward in a side view makes contact with the back.

From these facts, as the vertical rods 86 are pulled by the tensile material 90, the vertical rods 86 rise toward the body side of the seated person, and elastically deform to wrap the body from the sides. That is, the vertical rods 86 are elastically deformed, without being caused by the rearward elastic deformation of the upper rod 87 connecting the upper ends of the vertical rods 86, the connecting section of the lower ends of the vertical rods 86, or the like. At this time, the upper rod 87 suppresses excessive elastic deformation of the vertical rods 86.

As described above, with the frame rods 51 of the seat top frame 50U of the seat body 4 constituting the support section of the present invention, and the vertical rods 86 of the back front frame 80F of the backrest 7 constituting the support section of the present invention, elasticity deformation is promoted while suppressing excessive deformation, due to complex factors such as the cross-sectional shape thereof, the tension of the tensile materials 60 and 90 constituting the load supporting surface, and the engagement with the other parts of the seat top frame 50U and the other parts of the back front frame 80F.

In the chair 100 configured as described above, in the seat body 4, the frame rods 51 are disposed above the first seat reinforcing rods 41. Therefore, the frame rods 51 elastically deform to follow the body of the seated person, corresponding to a separation distance in the vertical direction between the frame rod 51 and the first seat reinforcing rod 41, by the load applied from the seated person as described above. Further, since the frame rods 51 are disposed outside the first seat reinforcing rods 41 when the load support surface 60U is viewed in the surface perpendicular direction from the load support surface 60U side, the frame rods 51 are pulled by the tensile material 60, are displaced to the central side of the load support surface 60U, rise toward the body side of the seated person and are displaced so as to wrap the body from the sides. Therefore, the seated person can sit in a stable state.

Further, in the backrest 7, the vertical rods 86 are disposed in front of the lateral side portions 72. Therefore, the vertical rods 86 elastically deform to follow the body of the seated person, corresponding to a separation distance in the front-rear direction between the vertical rod 86 and the lateral side portion 72, by the load applied from the seated person. Further, since the vertical rods 86 are disposed outside the side edge portions 72 when the load support surface 90F is viewed in the surface perpendicular direction from the load support surface 90F side, the vertical rods 86 are pulled by the tensile material 90, are displaced to the central side of the load support surface 90F, rise toward the body side of the seated person and are displaced so as to wrap the body from the sides. Therefore, the seated person can sit in a stable state.

Even if the seated person sits at a position displaced from the center of the load support surfaces 60U and 90F of the tensile materials 60 and 90, since the frame rods 51 and the vertical rods 86 themselves are elastically deformed and bent, the user does not feel the hardness of the frame rod 51 and the vertical rod 86 and does not feel uncomfortable.

In the seat body 4, both end portions of the frame rod 51 are connected to both end portions 41E of the first seat reinforcing rod 41 disposed along the frame rod 51 via the end portions of the connecting rods 52, the end portions of the second seat reinforcing rods 42 and the screws 52X. Therefore, since the frame rod 51 is supported by the first seat reinforcing rod 41 over the extending direction (the front-rear direction), excessive displacement is suppressed.

Further, in the backrest 7, both end portions of the vertical rod 86 are connected to both end portion sides of the lateral side portion 72 disposed along the vertical rod 86 via the upper arm section 81 and the lower arm section 82. Therefore, since the vertical rod 86 is supported by the lateral side portion 72 over the extending direction (the vertical direction), excessive displacement is suppressed.

Since the frame rod 51 and the vertical rod 86 are formed in a plate shape in which the surface perpendicular direction of the load support surfaces 60U and 90F is set as the thickness direction of the load support surfaces 60U and 90F, respectively, the frame rod 51 and the vertical rod 86 themselves are easily deformed by the load support surfaces 60U and 90F. Therefore, the frame rods 51 and the vertical rods 86 are pulled by the tensile materials 60 and 90, rise toward the body side of the seated person, and more easily deform to wrap the body from the sides.

Further, the frame rod 51 and the vertical rod 86 are formed such that the thickness thereof in the surface perpendicular direction becomes thinner toward the inner edge side. Therefore, the inner edge sides of the frame rod 51 and the vertical rod 86 are pulled by the tensile material 60 and displaced in a load input direction (downward in the case of the frame rod 51 and rearward in the case of the vertical rod 86), and the outer edge sides of the frame rod 51 and the vertical rod 86 are easily displaced in a direction of rising (upward in the case of the frame rod 51 and forward in the case of the vertical rod 86) against the displacement of the inner edge sides.

In addition, in the seat body 4, since the end portions of the pair of frame rods 51 are connected by the connecting rod 52, excessive displacement of the frame rods 51 is further suppressed.

Further, in the seat body 4, since the second seat reinforcing rod 42 is provided at the lower part of the connecting rod 52, the connecting rod 52 can be strongly reinforced. Therefore, it is possible to reliably bend the frame rods 51 connected to the connecting rod 52, while suppressing the deflection of the connecting rod 52 by the load from the seated person.

In addition, in the seat body 4, since the first seat reinforcing rods 41 and the second seat reinforcing rods 42 form an annular shape, the rigidity is enhanced, and the frame rods 51 can be stably supported.

Further, the shapes and combinations of the constituent members shown in the above-described embodiments are merely examples, and various modifications can be made on the basis of design requirements or the like, within the scope that does not depart from the gist of the present invention.

For example, in the above-described embodiment, both the seat body 4 and the backrest 7 are made up of the load support structure for a chair according to the present invention, but the present invention is not limited thereto, and only at least one of them may be made up of the load support structure for a chair of the present invention.

In the aforementioned embodiment, the frame rod 51 and the vertical rod 86 are each formed in a plate shape along the load support surfaces 60U and 90F, but the present invention is not limited thereto, and the plate rod 51 and the vertical rod 86 may have a shape other than a plate shape.

Although the seat bottom frame 40D and the seat top frame 50U are configured as separate bodies in the above-described embodiment, the seat bottom frame 40D and the seat top frame 50U may be integrally formed. In this case, by adopting means such as two-color molding of resin, it is possible to make the strength of the seat bottom frame 40D and the seat top frame 50U different from each other, or it is also possible to make the strengths of both the same. When the strengths of both are the same, as the seat bottom frame 40D is supported by the seat receiving member 3, the first seat reinforcing rod 41 and the second seat reinforcing rod 42 of the seat bottom frame 40D function as the first reinforcing section and the second reinforcing section, respectively.

Second Embodiment

Hereinafter, a chair according to the second embodiment of the present invention will be described with reference to the drawings.

Figure 8:
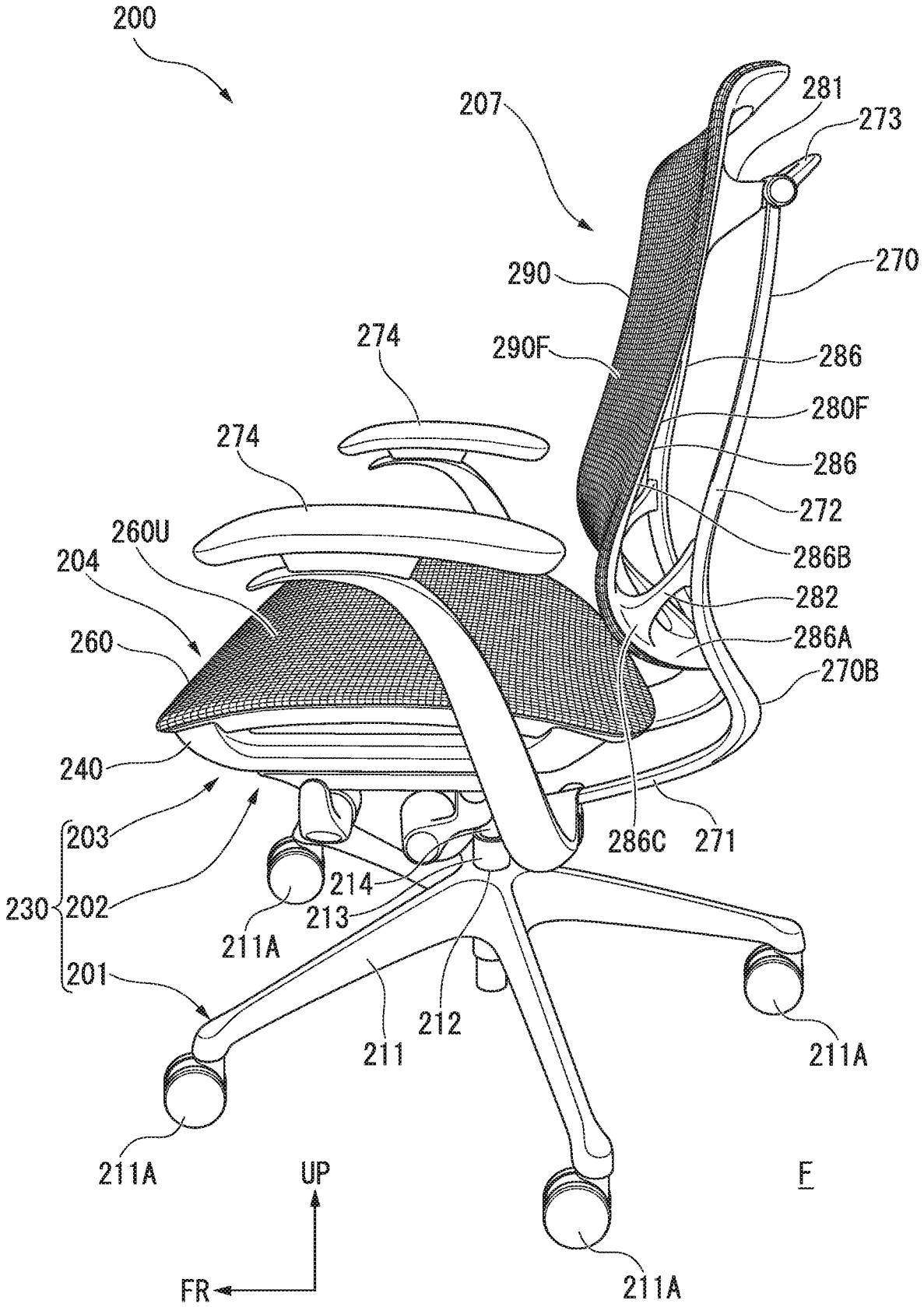
FIG. 8 is a side perspective view of a chair according to a second embodiment of the present invention as viewed from a lateral side.
Figure 9:
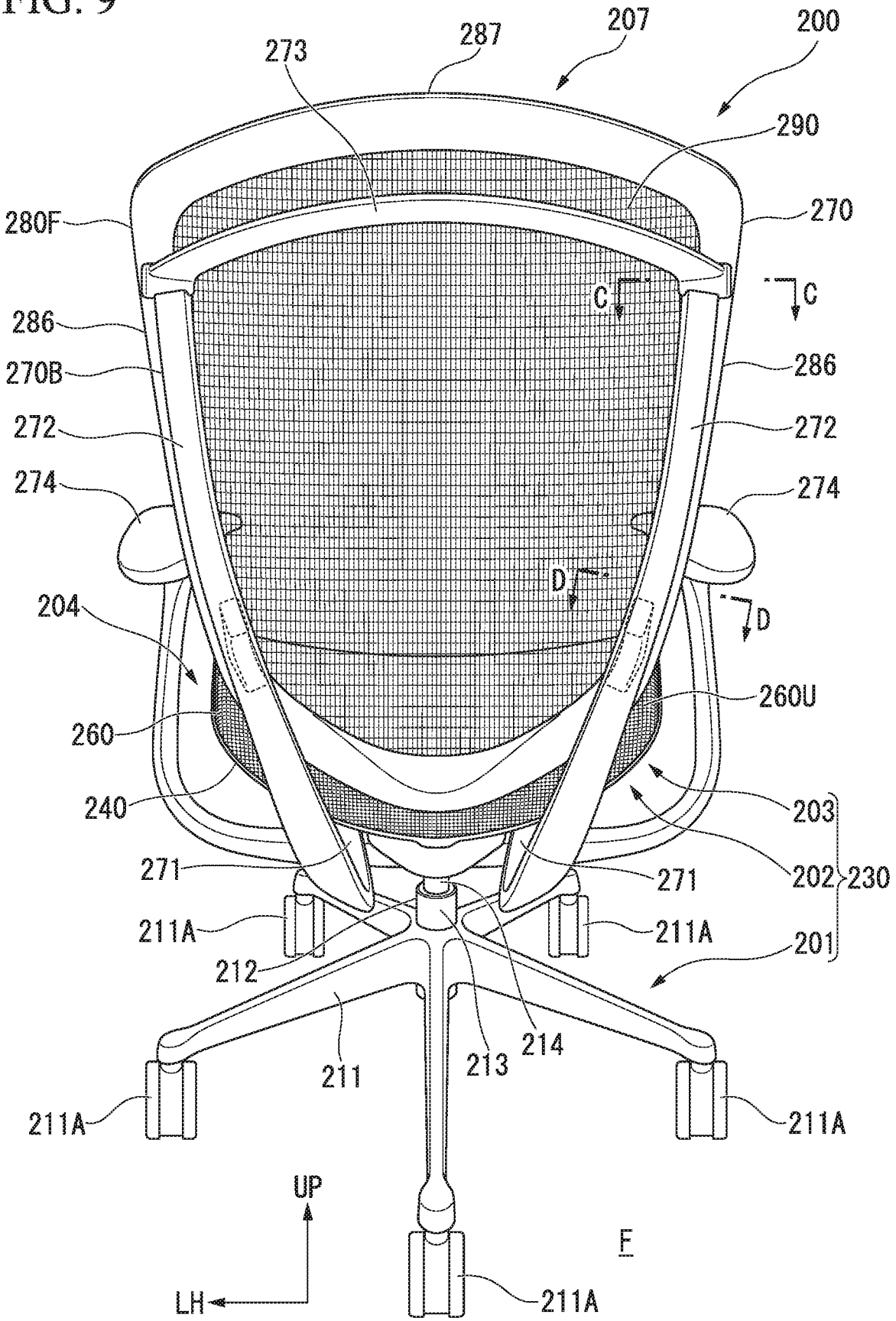
FIG. 9 is a perspective view of the chair according to the second embodiment of the present invention as viewed from behind (the backrest side).

FIG. 8 is a perspective view of a chair according to the second embodiment of the present invention as viewed from a lateral side. FIG. 9 is a perspective view of the chair according to the second embodiment of the present invention as viewed from behind (the backrest side).

As shown in FIGS. 8 and 9, a chair 200 has a leg section 201 installed on a floor surface F, a box-like support base 202 (not shown) installed on an upper part of the leg section 201, a seat receiving member 203 attached to an upper part of the support base 202, a seat body (a load support body for a chair) 204 that is slidably supported by the seat receiving member 203 and on which a seated person sits, and a backrest 207 extending from the support base 202 to support the back of the seated person seated on the seat body 204.

In the following description, for convenience, a direction in which the seated person seated on the seat body 204 faces forward is referred to as a "forward", and an opposite direction thereof is referred to as a "rearward". Further, a direction connecting the floor surface F side on which the chair 200 is installed and an opposite side thereto is referred to as a "vertical direction". Further, a width direction of the chair 200, that is, a horizontal direction orthogonal to the front-rear direction, is referred to as a "left-right direction". In the drawings, the forward direction is indicated by an arrow FR, the upward direction is indicated by an arrow UP, and the leftward direction is indicated by an arrow LH.

The leg section 201 has a multi-legged bar 211 with casters 211A, and a leg pillar 212 which stands up from a central part of the multi-legged bar 211 and incorporates a gas spring (not shown) as an elevating mechanism.

An outer cylinder 213, which constitutes a lower part of the leg pillar 212, is fitted and supported on the multi-legged bar 211 in a non-rotatable manner. The support base 102 is fitted and supported on an upper end portion of an inner cylinder 214 which constitutes an upper part of the leg pillar 212, and a lower part of the inner cylinder 214 is supported by the outer cylinder 213 to be rotatable in the horizontal direction.

The support base 202 incorporates an elevating movement adjustment mechanism of the leg pillar 212, and a tilting adjustment mechanism of the backrest 207.

The seat receiving member 203 has four link arms (not shown) attached to the upper part of the support base 202, and a pair of right and left fixed frames 231 (see a broken line shown in FIG. 10) which connect the link arms to each other.

In this embodiment, the leg section 201, the support base 202, and the seat receiving member 203 constitute a support body 230.

The seat body 204 has a seat frame (an annular body) 240, and an elastically deformable tensile material 260 stretched over the seat frame 240. An upper surface of the tensile material 260 serves as a load support surface 260U that receives the load of the seated person.

Figure 10:
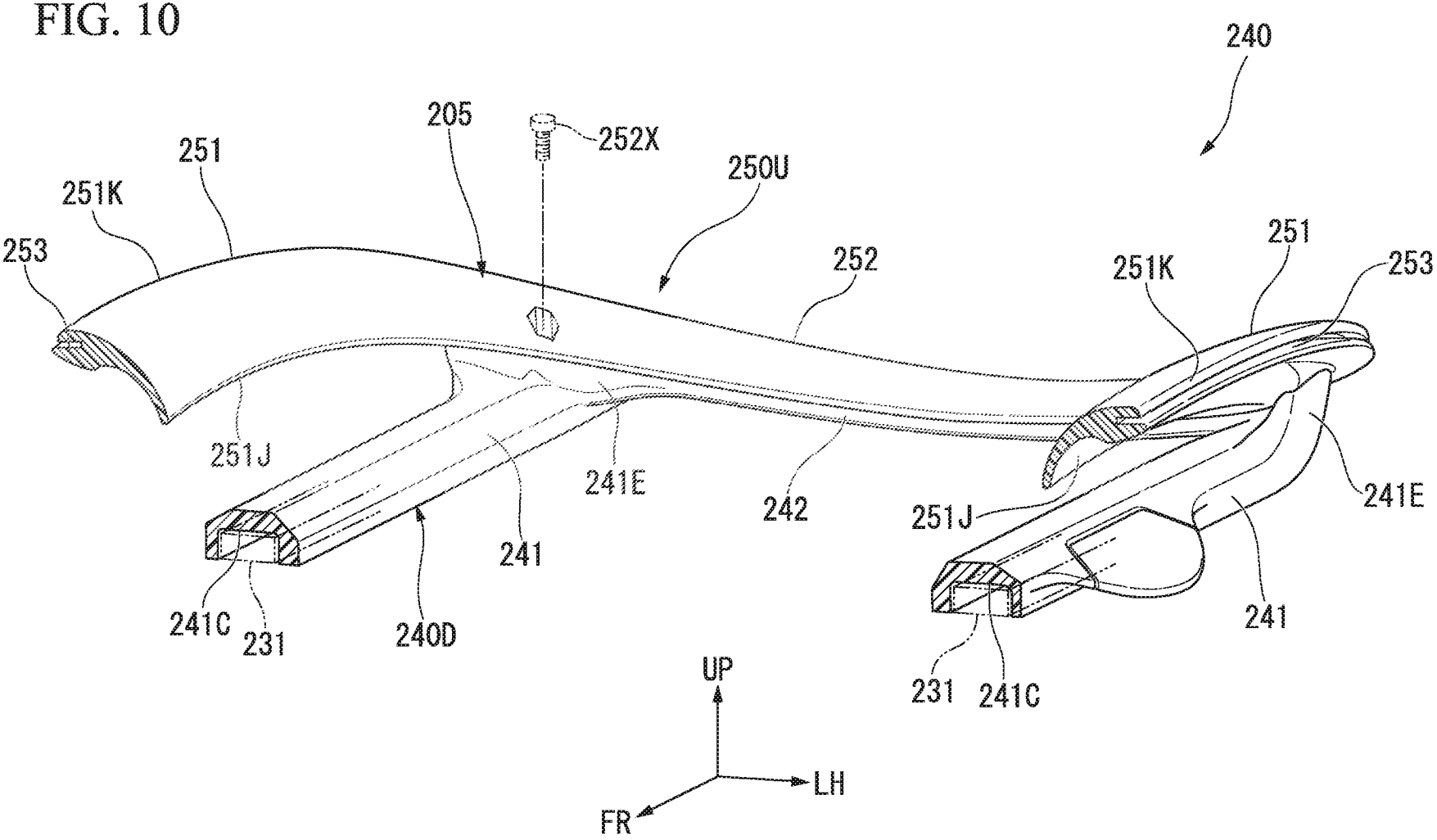
FIG. 10 is a vertical cross-sectional view of a seat body of the chair according to the second embodiment of the present invention taken along the left-right direction.
Figure 11:
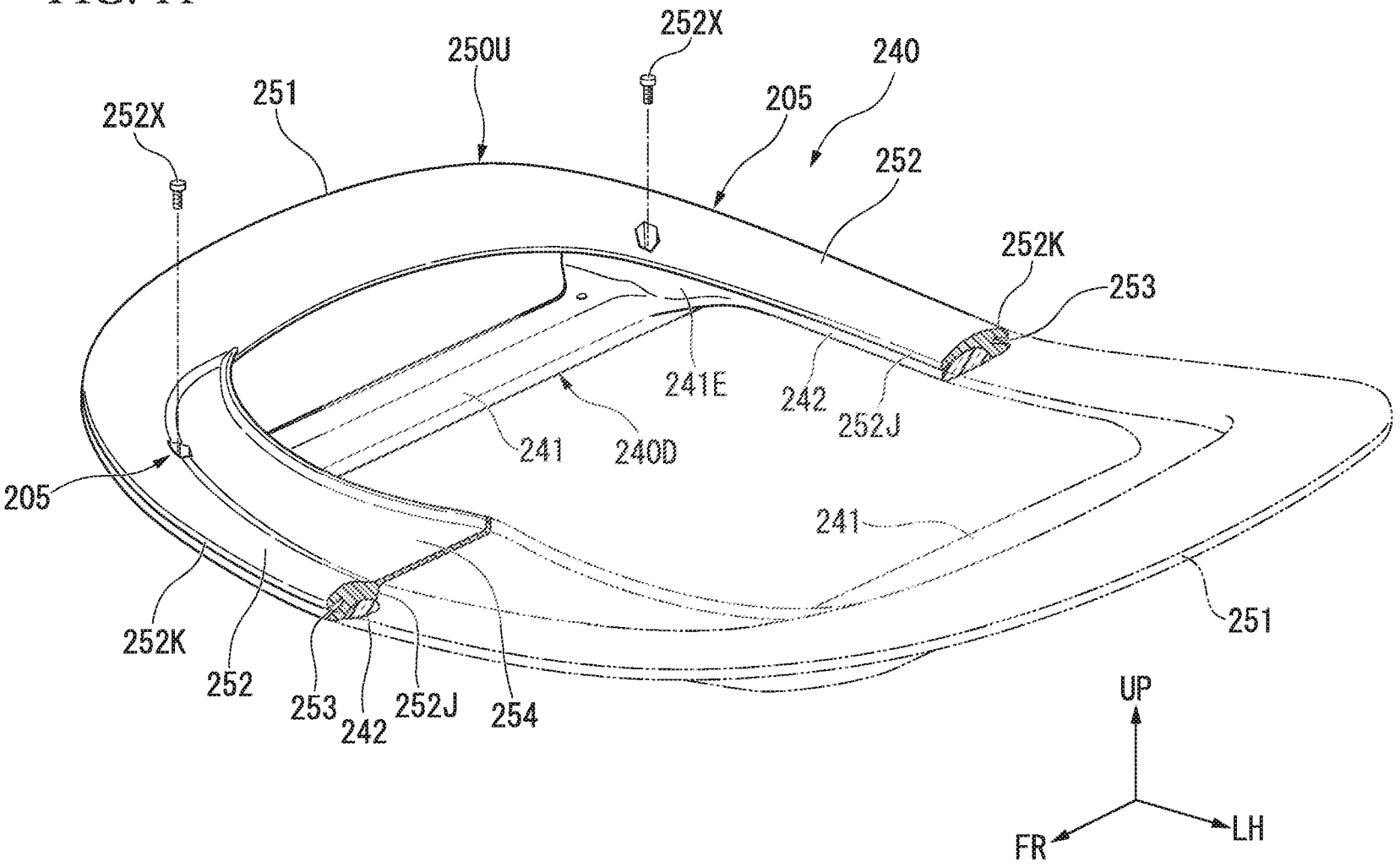
FIG. 11 is a vertical cross-sectional view of the seat body of the chair according to the second embodiment of the present invention taken along the front-rear direction.
Figure 12:
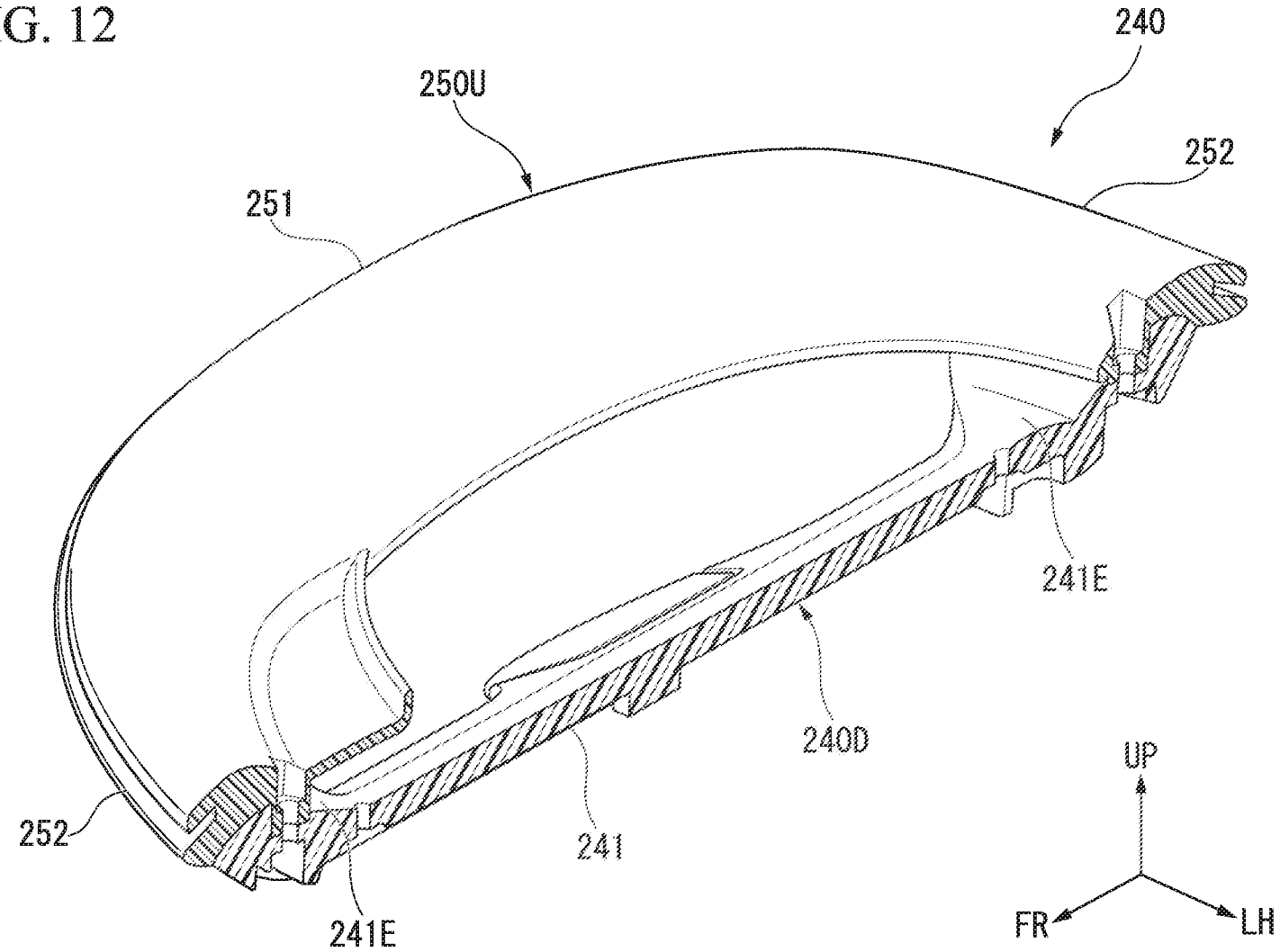
FIG. 12 is a vertical cross-sectional view of the seat body of the chair according to the second embodiment of the present invention taken along the front-rear direction and taken at an outer side in the left-right direction of the seat body compared to FIG. 11.

FIG. 10 is a vertical cross-sectional view of the seat body 204 of the chair 200 taken along the left-right direction. FIG. 11 is a vertical cross-sectional view of the seat body 204 of the chair 200 taken along the front-rear direction. FIG. 12 is a vertical sectional view of the seat body 204 of the chair 200 taken along the front-rear direction. FIG. 12 is a cross-sectional view taken on the outer side in the left-right direction of the seat body 204 compared to FIG. 11. In FIGS. 10 to 12, the tensile material 260 is not shown.

As shown in FIGS. 10 to 12, the seat frame 240 has a seat bottom frame 240D supported by the fixed frames 231, and a seat top frame 250U fixed to an upper surface of the seat bottom frame 240D. Each of the seat bottom frame 240D and the seat top frame 250U is annularly formed.

The seat bottom frame 240D has first seat reinforcing rods (a connection reinforcing section) 241 slidably provided on the pair of fixed frames 231, respectively, and second seat reinforcing rods (an elastic reinforcing section) 242 each of which connects end portions 241E of the first seat reinforcing rods 241 to each other. The first seat reinforcing rods 241 and the second seat reinforcing rods 242 are integrally formed of, for example, a resin or the like, and have a predetermined strength.

As shown in FIG. 10, the first seat reinforcing rod 241 extends in the front-rear direction. The first seat reinforcing rod 241 has a downward U shape in a cross section along a surface perpendicular direction, which is a direction perpendicular to the load support surface 260U (see FIG. 8, the same applies hereinafter). In other words, a concave section 241C that is recessed upward is formed in a lower part of the first seat reinforcing rod 241. The fixed frame 231 is disposed in the concave section 241C.

Both end portions 241E of the first seat reinforcing rod 241 are formed to have a larger width in the left-right direction than a portion of the first seat reinforcing rod 241 on a central side in the front-rear direction. Both end portions 241E of the first seat reinforcing rod 241 are gradually inclined upward toward a distal end side.

As shown in FIG. 11, the second seat reinforcing rod 242 extends in the left-right direction. The second seat reinforcing rod 242 is has a plate shape wider in the front-rear direction, in a cross section along the surface perpendicular direction (a vertical cross section along the front-rear direction).

As shown in FIGS. 10 to 12, the seat top frame 250U includes a pair of frame rods (a first part) 251 disposed to be spaced apart from each other in the left-right direction (in a direction along the load support surface 260U), and connecting rods (a second part) 252 each of which connects end portions of the frame rods 251 to each other. The frame rods 251 and the connecting rods 252 are integrally formed of, for example, a resin or the like, and configured to be elastically deformable in response to a force acting from the tensile material 260 (see FIG. 8, the same applies hereinafter).

As shown in FIG. 10, the frame rod 251 extends in the front-rear direction. The frame rod 251 has a plate shape extending along the load support surface 260U and wider in the left-right direction, in a cross section along the surface perpendicular direction (a vertical cross section along the left-right direction).

The frame rod 251 is formed such that the thickness thereof in the surface perpendicular direction becomes thinner toward an inner edge (an inner end portion in the left-right direction) 251J. Further, the inner edge 251J of the frame rod 251 is inclined downward.

A groove 253 recessed inward is formed in an outer edge (an outer end portion in the left-right direction) 251K of the frame rod 251. An end portion of the tensile material 260 is caught in the groove 253.

As shown in FIG. 11, the connecting rod 252 extends in the left-right direction. The connecting rod 252 has a plate shape wider in the front-rear direction, in a cross section along the surface perpendicular direction (a vertical cross section along the front-rear direction).

The rear connecting rod 252 is gradually inclined downward toward the rear.

The rear connecting rod 252 is formed such that the thickness thereof in the surface perpendicular direction becomes thinner toward an inner edge (an inner end portion in the front-rear direction) 252J. A reinforcing plate section 254 having a plate shape extending along the horizontal plane is provided on the inner edge 252J of the front connecting rod 252.

Both end portions of the reinforcing plate section 254 in the left-right direction are connected to the respective frame rods 251. Therefore, a front part of the seat top frame 250U including a boundary region between the frame rod 251 and the connecting rod 252 is prevented from hanging down forward and downward due to the load that is input from the body of the seated person.

A cushion body having elasticity (not shown, the same applies hereinafter) may be placed on an upper surface of the reinforcing plate section 254. As a result, a front part of the tensile material 260 stretched over the seat top frame 250U is supported by the cushion body and urged upward. The seated person feels a good seating comfort while thighs of the seated person are flexibly supported on the tensile material 260, and because the thighs do not come into direct contact with an inner peripheral edge of the connecting rod 252, the seated person does not feel the hardness of the connecting rod 252 and does not feel uncomfortable.

The groove 253 recessed inward is formed on an outer edge (an outer end portion in the front-rear direction) 252K of the connecting rod 252. The end portion of the tensile material 260 is caught in the groove 253.

The second seat reinforcing rod 242 is provided on a lower part on the inner edge 252J side of the connecting rod 252. Both end portions of the connecting rod 252 are screwed to the respective end portions of the second seat reinforcing rod 242 by screws 252X.

The length of the connecting rod 252 is longer than the length of the second seat reinforcing rod 242 of the seat bottom frame 240D. As a result, the frame rod 251 connected to the end portion of the connecting rod 252 is disposed on the outer side (the outer side in the left-right direction) than the first seat reinforcing rod 241 connected to the end portion of the second seat reinforcing rod 242 when the load support surface 260U is viewed in the surface perpendicular direction from the load support surface 260U side.

In the present embodiment, the end portions of the connecting rods 252, the end portions of the second seat reinforcing rods 242, and the screws 252X constitute a connecting body 205 which connects the frame rod 251 and the first seat reinforcing rod 241. Since the end portion 241E of the first seat reinforcing rod 241 is gradually inclined upward toward the distal end side, the frame rod 251 is disposed above the first seat reinforcing rod 241.

Further, the end portion of the connecting rod 252 is gradually inclined upward toward the outer side in the left-right direction. As a result, the frame rod 251 is disposed above the connecting rod 252.

As shown in FIGS. 8 and 9, the backrest 207 includes a back frame 270, and a tensile material 290 stretched over the back frame 270. A front surface of the tensile material 290 serves as a load support surface 290F that receives the load of the seated person.

The back frame 270 has a back rear frame 270B connected to the support base 202, and a back front frame 280F provided in front of the back rear frame 270B.

The back rear frame 270B has lower side portions 271, lateral side portions 272, and an upper side portion 273. The lower side portions 271, the lateral side portions 272, and the upper side portion 273 are formed integrally by, for example, a metal such as aluminum or a resin having a predetermined strength.

The lower side portions 271 are connected to the tilting adjustment mechanism in the support base 202 and extend from both the left and right sides of the rear part of the support base 202. The lower side portion 271 is gradually inclined rearward toward the upper part. Also, an armrest 274 extending sideways is provided in each lower side portion 271.

The lateral side portion 272 is connected to the upper end portion of each lower side portion 271. Each lateral side portion 272 is gradually inclined outward in the left-right direction toward the upper part.

A lower part of the lateral side portion 272 is gradually inclined forward toward the upper part.

An upper part of the lateral side portion 272 is gradually inclined rearward toward the upper side. The upper parts of the lateral side portions 272 are connected to each other by the upper side portion 273.

Figure 13:
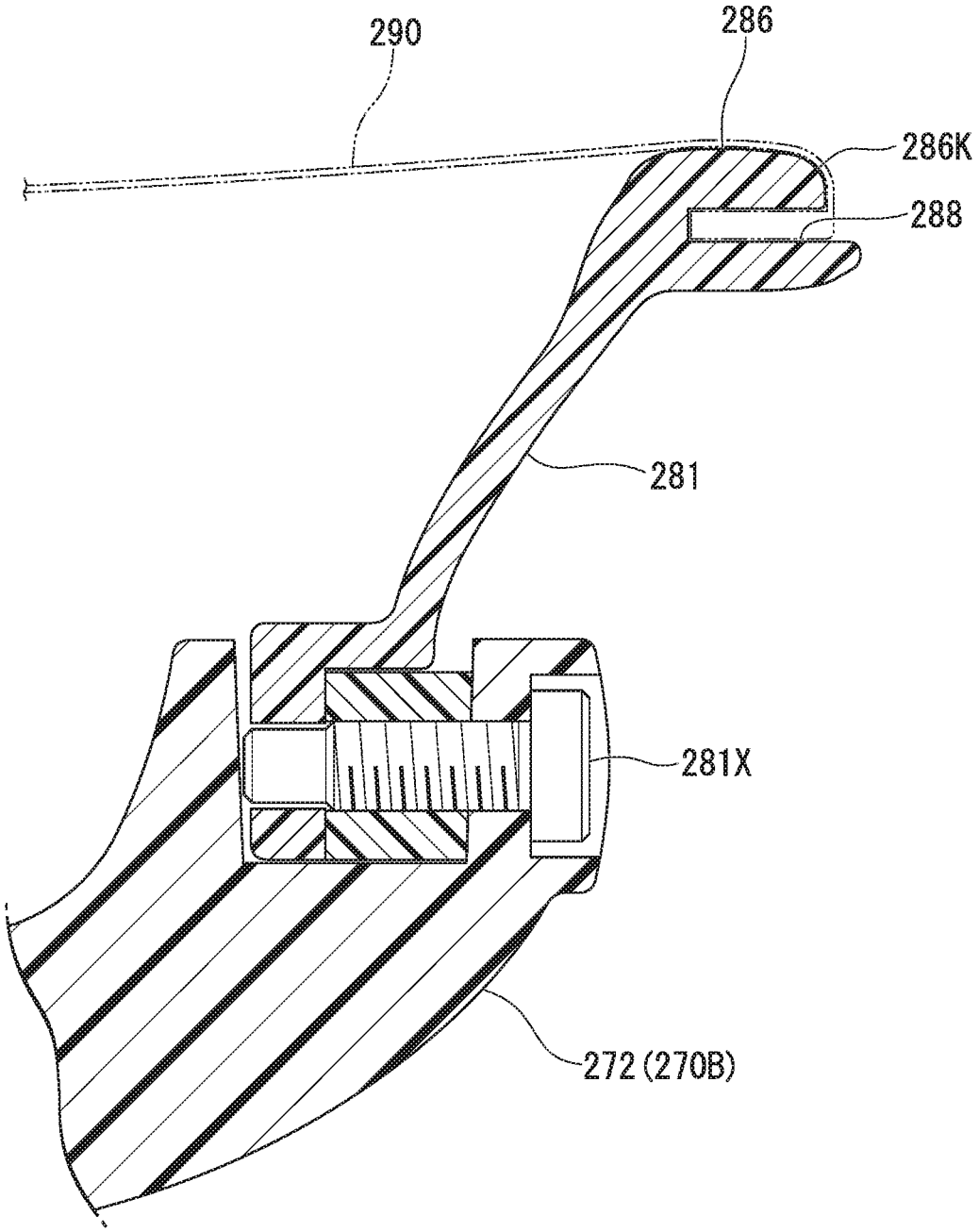
FIG. 13 is a cross-sectional view taken along a line C-C of FIG. 9.
Figure 14:
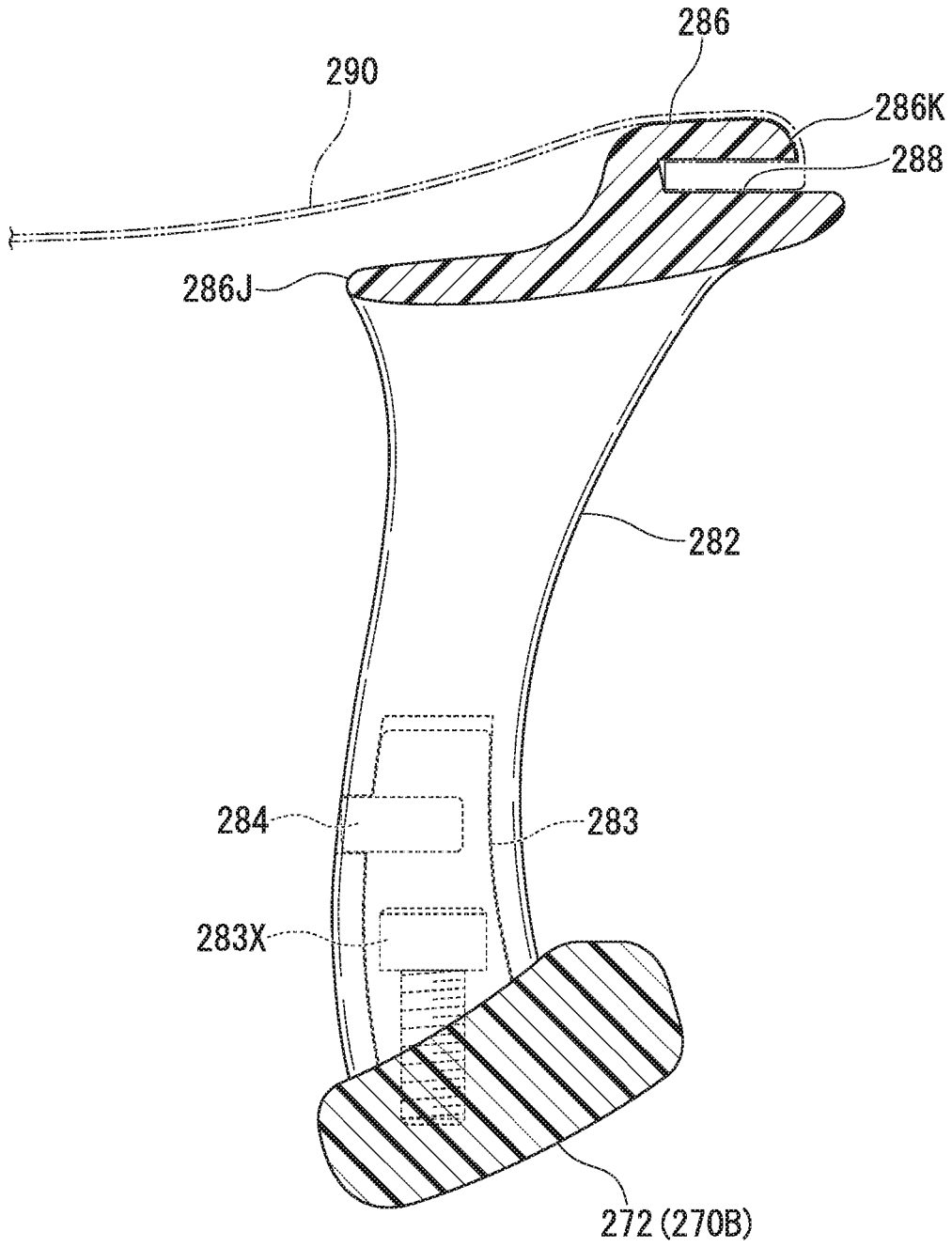
FIG. 14 is a cross-sectional view taken along a line D-D of FIG. 9.

FIG. 13 is a cross-sectional view taken along the line C-C of FIG. 9. FIG. 14 is a cross-sectional view taken along the line D-D of FIG. 9.

As shown in FIGS. 8, 9, 13, and 14, the back front frame 280F has upper arm sections 281 connected to the upper parts of the lateral side portions 272 of the back rear frame 270B, lower arm sections 282 connected to the lower parts of the lateral side portions 272, a pair of vertical rods 286 disposed to be spaced apart from each other in the left-right direction (along load support surface 260U), and an upper rod 287 which connects the upper ends of the pair of vertical rods 286. The upper arm sections 281, the lower arm sections 282, the vertical rods 286, and the upper rod 287 are integrally formed of, for example, resin or the like. The vertical rods 286 and the upper rod 287 are configured to be elastically deformable in accordance with the force acting from the tensile material 290.

As shown in FIG. 13, the upper arm section 281 is fixed to the upper part of the lateral side portion 272 of the back rear frame 270B by a bolt 281X. The upper arm section 281 extends forward from the lateral side portion 272 of the back rear frame 270B, and gradually extends outward in the left-right direction toward the front part.

As shown in FIG. 14, a fixed piece 283 is fixed to the lower part of the lateral side portion 272 of the back rear frame 270B with a bolt 283X. The lower arm section 282 externally fits the fixed piece 283. The lower arm section 282 and the fixed piece 283 are fixed by a retaining pin 284. The lower arm section 282 extends forward from the lateral side portion 272 of the back rear frame 270B and gradually extends outward in the left-right direction toward the front part.

As shown in FIG. 8, the upper arm section 281 is connected to the upper part of the vertical rod 286, and the lower arm section 282 is connected to the lower part of the vertical rod 286.

As shown in FIG. 9, each vertical rod 286 extends in the vertical direction. In detail, the vertical rod 286 is gradually inclined inward in the left-right direction toward the lower part. The lower ends of the pair of vertical rods 286 are connected to each other.

As shown in FIG. 8, a lower part 286A of the vertical rod 286 is gradually inclined forward toward the upper part. An upper part 286B of the vertical rod 286 is gradually inclined rearward toward the upper part. Accordingly, in a side view, a boundary section 286C between the lower part 286A and the upper part 286B has a shape protruding forward. The lower arm section 282 is connected to a rear surface of the boundary section 286C.

As shown in FIGS. 13 and 14, the vertical rod 286 has a plate shape extending along the load support surface 290F wider in the left-right direction, in a cross section along the surface perpendicular direction, which is a direction perpendicular to the load support surface 290F (see FIG. 8) (a horizontal cross section along the left-right direction).

As shown in FIG. 14, the lower part of the vertical rod 286 is formed such that the thickness thereof in the surface perpendicular direction becomes thinner toward an inner edge (an inner end portion in the left-right direction) 286J.

A groove 288 recessed inward is formed in an outer edge (an outer end portion in the left-right direction) 286K of the vertical rod 286. The end portion of the tensile material 290 is caught in the groove 288.

Since the upper arm section 281 and the lower arm section 282 gradually extend outward in the left-right direction toward the front, the vertical rod 286 is disposed outside the lateral side portion 272 in the left-right direction.

Next, the deformation of the seat body 204 when the seated person sits on the seat body 204 of the chair 200 will be described.

First, a description will be given of a case (hereinafter, this case will be referred to as a first seated state) in which the seated person sits on the rear part of the central part in the left-right direction (the width direction) of the load support surface 260U of the seat body 204.

Since the load support surface 260U is made up by the elastically deformable tensile material 260, the tensile material 260 elastically deforms to sink downward by the load acting from the seated person.

Since the rear connecting rod 252 on which the tensile material 260 is stretched gradually inclines downward toward the rear, the connecting rod 252 is easy to elastically deform downward. Here, since a second seat reinforcing rod 242 is provided at the lower part of the connecting rod 252, it is possible to prevent the central part in the left-right direction of the connecting rod 252 from being excessively descended downward and being bent.

Both the left and right sides of the front end portion of the rear connecting rod 252 and both the left and right sides of the rear end portion of the front connecting rod 252 are connected by the first seat reinforcing rods 241, respectively. Therefore, the left and right frame rods 251, which are disposed outside in the left-right direction than the connecting rods 252, are restrained by the connecting rod 252 and elastically deform gradually upward from the rear part.

Next, the description will be given of a case (hereinafter, this case will be referred to as a second seated state) in which the seated person sits slightly in front of a central part in the front-rear direction of the load support surface 260U of the seat body 204 and the central part in the left-right direction (the width direction) of the load support surface 260U.

In the second seated state, since the seating position is ahead of the first seated state, the amount of elastic deformation of the rear connecting rod 252 toward the lower side is smaller than in the case of the first seated state.

However, the frame rods 251, each of which has a plate shape in the cross-sectional view taken along the surface perpendicular direction of the tensile material 260, are pulled by the tensile material 260 elastically deforming in the surface perpendicular direction, rise toward the body side of the seated person, and elastically deform to wrap the body from the sides. At this time, the pair of front and rear connecting rods 252 suppress excessive elastic deformation of the frame rod 251.

Next, the deformation of the backrest 207 when the seated person puts his back against the backrest 207 will be described.

When the back is put against the load support surface 290F of the backrest 207 made up of the tensile material 290, the load in the surface perpendicular direction acting on the tensile material 290 is not so large as the load acting on the load support surface 260U of the seat body 204. Further, the vicinity of the boundary sections 286C that protrude forward in a side view makes contact with the back. From these facts, since the vertical rods 286 are pulled by the tensile material 290, the vertical rods 286 rise toward the body side of the seated person, and elastically deform to wrap the body from the sides. That is, the vertical rods 286 are elastically deformed, without being caused by the rearward elastic deformation of the upper rod 287 connecting the upper ends of the vertical rods 286, the connecting section of the lower ends of the vertical rods 286, and the like. At this time, the upper rod 287 suppresses excessive elastic deformation of the vertical rods 286.

As described above, with the frame rods 251 of the seat top frame 250U of the seat body 204 constituting the support section of the present invention, and the vertical rod 286*s* of the back front frame 280F of the backrest 207, elasticity deformation is promoted while suppressing excessive deformation, due to complex factors such as the cross-sectional shape thereof, the tension of the tensile materials 260 and 290 constituting the load supporting surface, and the engagement with the other parts of the seat top frame 250U and the other parts of the back front frame 280F.

In the chair 200 having such a configuration, the tensile material 260 is flexibly bent at the central side of the load support surface 260U in a load input direction, and the frame rods 251, which are arranged opposite to each other, elastically deform to follow the body of the seated person by the load acting from the seated person. Therefore, the frame rods 251 can receive the seated person together with the tensile material 260 by wrapping the seated person.

In addition, since the second seat reinforcing rods 242 for enhancing the rigidity are provided only on the connecting rods 252 among the frame rods 251 and the connecting rods 252, the connecting rods 252 can be strongly reinforced. Therefore, excessive displacement and bending of the frame rods 251 can be suppressed by the connecting rods 252 arranged between the pair of frame rods 251.

In addition, since the frame rods 251 are disposed on a side (upper side) closer to an input direction of the load than the connecting rods 252, the frame rods 251 are easily displaced to rise toward the body side of the seated person and wrap the body from the sides.

In addition, since the first seat reinforcing rods 241 and the second seat reinforcing rods 242 form an annular shape, the rigidity is enhanced, and the frame rods can be stably supported.

Further, since the frame rod 251 is disposed to be spaced apart from the first seat reinforcing rod 241 in the surface perpendicular direction of the load support surface 260U, the frame rod 251 can be elastically deformed sufficiently to correspond to the separation distance in the surface perpendicular direction.

Further, since the frame rods 251 are disposed outside the first seat reinforcing rods 241 when the load support surface 260U is viewed in the surface perpendicular direction from the load support surface 260U side, when the frame rods 251 are pulled by the tensile material 260, the frame rods 251 are easily displaced toward the central side of the load support surface 260U to rise toward the body side of the seated person and wrap the body from the sides.

Further, since the frame rod 251 is formed in a plate shape along the load support surface 260U, the frame rod 251 itself is easily deformed along the load support surface 260U. Therefore, when the frame rods 251 are pulled by the tensile material 260, the frame rods 251 are more easily displaced to rise toward the body side of the seated person and wrap the body from the sides.

Further, the frame rod 251 is formed such that the thickness thereof in the surface perpendicular direction becomes thinner toward the inner edge side. Therefore, the inner edge sides of the frame rod 251 are pulled by the tensile material 260 and displaced to a side (downward) away from the input direction of the load, and the outer edge sides of the frame rod 251 are easily displaced in a direction of rising (a side close to the input direction of the load, upward) against the displacement of the inner edge sides.

Since the second seat reinforcing rod 242 is formed as a separate body from the connecting rod 252, the second seat reinforcing rod 242 is simply connected to the connecting rod 252 by the screw 252X, and the second seat reinforcing rod 242 can be easily manufactured. In addition, the shapes of the second seat reinforcing rod 242 and the connecting rod 252 can be simplified, and the volumes of the second seat reinforcing rod 242 and the connecting rod 252 can be reduced. As a result, it is possible to prevent defective molding of the second seat reinforcing rod 242 and the connecting rod 252.

Further, the shapes and combinations of the constituent members shown in the above-described embodiments are merely examples, and various modifications can be made on the basis of design requirements or the like in the scope that does not depart from the gist of the present invention.

For example, in the above-described embodiment, the seat body 204 is constituted by the load support body for a chair according to the present invention, but the present invention is not limited thereto, and the backrest may be configured by the load support body for a chair according to the present invention.

Further, in the above-described embodiment, the second part and the reinforcing section are formed as separate bodies, but the present invention is not limited thereto, and the second part and the reinforcing section may be formed as a single body. In this case, the body is constituted by increasing the thickness in the surface perpendicular direction of the integrated second part and reinforcing section. Therefore, it can easily be reinforced over a wide range in the extending direction (longitudinal direction) of the second part.

INDUSTRIAL APPLICABILITY

According to the load support structure for a chair and the chair according to the present invention, it is possible to suppress excessive displacement, while allowing elastic deformation of a support section to which a tensile material is attached.

Further, according to the load support body for a chair and the chair according to the present invention, it is possible to suppress excessive displacement, while allowing elastic deformation of the annular body to which the tensile material is attached.

REFERENCE SIGNS LIST

1 Leg section
2 Support base
3 Seat receiving member
4 Seat body (load support structure for chair)
5 Connecting body
7 Backrest (load support structure for chair)
30 Support body
40 Seat frame
40D Seat bottom frame
41 First seat reinforcing rod (first reinforcing section)
42 Second seat reinforcing rod (second reinforcing section)
50U Seat top frame
51 Frame rod (support section)
52 Connecting rod (connecting section)
60 Tensile material
60U Load support surface
70 Back frame
70B Back rear frame
71 Lower side portion
72 Lateral side portion (first reinforcing section)
73 Upper side portion
80F Back front frame
81 Upper arm section (connecting body)
82 Lower arm section (connecting body)
86 Vertical rod (support section)
87 Upper rod (connecting section)
90 Tensile material
100 Chair
201 Leg section
202 Support base
203 Seat receiving member
204 Seat body (load support body for chair)
205 Connecting body
207 Backrest
230 Support structure
240 Seat frame (annular body)
240D Seat bottom frame
241 First seat reinforcing rod (connection reinforcing section)
242 Second seat reinforcing rod (rigidity reinforcing section)
250U Seat top frame
251 Frame rod (first part)
252 Connecting rod (second part)
260 Tensile material
260U Load support surface
270 Back frame
270B Back rear frame
271 Lower side portion
272 Lateral side portion
273 Upper side portion
280F Back front frame
281 Upper arm section
282 Lower arm section
286 Vertical rod
287 Upper rod
290 Tensile material
200 Chair

The invention claimed is:

1. A chair comprising:
a support body disposed on a floor surface; and
a seat body and a backrest supported on the support body, wherein the seat body includes a load support structure for a chair,
the load support structure for the chair includes:
a tensile material on which a load support surface configured to receive a load of a seated person is formed;
a pair of support sections to which the tensile material is attached, and which is elastically deformable in response to a force acting from the tensile material;
a pair of first reinforcing sections which extends along an extending direction of the pair of support sections and is disposed to be spaced apart from the pair of support sections in a surface perpendicular direction perpendicular to the load support surface, the pair of first reinforcing sections being located on an opposite side to the load support surface across the pair of support sections; and
a connecting body which connects each of both end portions of the pair of support sections with a corresponding end portion of both end portions of the pair of first reinforcing sections,
each of the pair of support sections is disposed outside a corresponding first reinforcing section of the pair of first reinforcing sections in a view of the surface perpendicular direction, and
the pair of support sections extends in a direction in which the seated person extends on the load support surface.

2. The chair according to claim 1, wherein each of the pair of support sections is formed in a plate shape in which the surface perpendicular direction is set as a thickness direction of the each of the pair of support sections.

3. The chair according to claim 1, wherein each of the pair of support sections is formed such that a thickness in the surface perpendicular direction of one support section of the pair of support sections decreases toward the other support section of the pair of support sections.

4. The chair according to claim 1, wherein the load support structure for the chair further includes:
a pair of connecting sections which connects the both end portions of one support section of the pair of support sections to the both end portions of the other support section of the pair of support sections, and each of the both end portions of the pair of connecting sections constitutes a part of the connecting body.

5. The chair according to claim 4, wherein the load support structure for the chair further includes:

a pair of second reinforcing sections which connects the both end portions of one first reinforcing section of the pair of first reinforcing sections to the both end portions of the other first reinforcing section of the pair of first reinforcing sections and supports the pair of connecting sections, wherein each of both end portions of the pair of second reinforcing sections constitutes a part of the connecting body.

6. A chair comprising:

a support body disposed on a floor surface; and a seat body and a backrest supported on the support body, wherein the seat body includes a load support body for a chair, the load support body for the chair includes:

a tensile material on which a load support surface configured to receive a load of a seated person is formed; and an annular body which is annularly arranged around the tensile material and to which the tensile material is attached, the annular body includes:

a pair of first parts which is disposed to be spaced apart from each other along the load support surface and is elastically deformable in response to a force acting from the tensile material; and a pair of second parts which connects both end portions of one first part of the pair of first parts to both end portions of the other first part of the pair of first parts, a pair of rigidity reinforcing sections is provided only on the pair of second parts among the pair of first parts and the pair of second parts, the pair of rigidity reinforcing sections configured to reinforce the pair of second parts, and the pair of first parts extends in a direction in which the seated person extends on the load support surface.

7. The chair according to claim 6, wherein the pair of rigidity reinforcing sections and the pair of second parts are integrally formed in a surface perpendicular direction perpendicular to the load support surface.

8. The chair according to claim 6, wherein the pair of rigidity reinforcing sections is configured as a separate body from the pair of second parts.

9. The chair according to claim 6, wherein the pair of first parts is disposed above the pair of second parts.

10. The chair according to claim 6, wherein the annular body has a pair of connection reinforcing sections which connects both end portions of one rigidity reinforcing section of the pair of rigidity reinforcing sections to both end portions of the other rigidity reinforcing section of the pair of rigidity reinforcing sections and which is disposed to be spaced apart from the pair of first parts in a surface perpendicular direction perpendicular to the load support surface.

11. The chair according to claim 10, wherein each of the pair of first parts is disposed outside the pair of connection reinforcing sections in a view of the surface perpendicular direction.

12. The chair according to claim 6, wherein each of the pair of first parts is formed in a plate shape in which a surface perpendicular direction perpendicular to the load support surface is set as a thickness direction of the each of the pair of first parts.

13. The chair according to claim 6, wherein each of the pair of first parts is formed such that a thickness of one first part of the pair of the first parts decreases toward the other first part of the pair of first parts, the thickness in a surface perpendicular direction perpendicular to the load support surface.

* * * * *